US007982112B2

(12) United States Patent
Rovner

(10) Patent No.: US 7,982,112 B2
(45) **Date of Patent: *Jul. 19, 2011**

(54) LIGATURE FOR WOODWIND INSTRUMENTS

(76) Inventor: Philip Lee Rovner, Timonium, MD (US)

( * ) Notice: Subject to any disclaimer, the term of this patent is extended or adjusted under 35 U.S.C. 154(b) by 43 days.

This patent is subject to a terminal disclaimer.

(21) Appl. No.: 12/613,097

(22) Filed: Nov. 5, 2009

(65) Prior Publication Data

US 2010/0043621 A1 Feb. 25, 2010

Related U.S. Application Data

(63) Continuation-in-part of application No. 12/040,969, filed on Mar. 3, 2008, now Pat. No. 7,863,509, and a continuation-in-part of application No. 12/333,174, filed on Dec. 11, 2008.

(51) Int. Cl.
*G10D 9/02* (2006.01)

(52) U.S. Cl. ..... 84/383 R

(58) Field of Classification Search ..... 84/383 R
See application file for complete search history.

(56) References Cited

U.S. PATENT DOCUMENTS

| | | | | | |
|---|---|---|---|---|---|
| 2,499,855 | A | | 3/1950 | Gamble | |
| 3,433,113 | A | * | 3/1969 | Portnoy | 84/383 R |
| 3,905,268 | A | | 9/1975 | Gamble | |
| 4,210,055 | A | | 7/1980 | Platamone, Jr. | |
| 4,428,271 | A | | 1/1984 | Winslow et al. | |
| 4,517,875 | A | | 5/1985 | Dossekker | |
| 5,018,425 | A | * | 5/1991 | Rovner | 84/383 R |
| 5,192,821 | A | | 3/1993 | Goldstein et al. | |
| 5,289,752 | A | | 3/1994 | Barbaglia | |
| 5,357,837 | A | | 10/1994 | Disera | |
| 5,398,582 | A | | 3/1995 | Smith | |
| 5,419,229 | A | * | 5/1995 | Van Doren | 84/383 R |
| 5,623,111 | A | * | 4/1997 | van Doren et al. | 84/383 R |
| 5,728,957 | A | | 3/1998 | Valtchev | |
| D404,755 | S | * | 1/1999 | Garbuzov | D17/13 |
| 5,973,245 | A | | 10/1999 | Van Doren | |
| 5,998,715 | A | | 12/1999 | Rovner | |
| 6,020,545 | A | * | 2/2000 | Consoli | 84/383 R |
| 6,118,060 | A | * | 9/2000 | Van Doren | 84/398 |
| 6,130,376 | A | | 10/2000 | Chang | |
| 6,150,593 | A | | 11/2000 | Holden | |
| 7,169,993 | B2 | * | 1/2007 | Fliegel et al. | 84/383 A |
| 7,863,509 | B2 | * | 1/2011 | Rovner | 84/383 R |
| 2004/0011183 | A1 | * | 1/2004 | Fliegel et al. | 84/383 R |
| 2005/0061136 | A1 | * | 3/2005 | Rovner | 84/383 A |
| 2008/0022839 | A1 | | 1/2008 | Sullivan | |
| 2009/0217798 | A1 | | 9/2009 | Rovner | |
| 2009/0217800 | A1 | | 9/2009 | Rovner | |
| 2010/0043621 | A1 | * | 2/2010 | Rovner | 84/383 R |

* cited by examiner

*Primary Examiner* — Jeffrey Donels
*Assistant Examiner* — Robert W Horn
(74) *Attorney, Agent, or Firm* — August Law, LLC; George Willinghan

(57) ABSTRACT

A ligature is provided for use in a mouthpiece system for attaching a reed to a mouthpiece of a woodwind musical instrument. The ligature is constructed from a single layer of flexible strap, having two ends to which rigid bars are fixedly secured. The ends of the straps and rigid bars are brought together to form a loop that is placed over the mouthpiece and reed. A threaded closure mechanism is used to tighten the ligature around the mouthpiece. The ends of the strap are crimped into slots in the rigid bars to secure the flexible strap to the rigid bars. Slots or slits run along substantially the entire length of the flexible strap. Removable masses are attached to the ligature in contact with the rigid bars.

20 Claims, 15 Drawing Sheets

LIGATURE FOR WOODWIND INSTRUMENTS

CROSS-REFERENCE TO RELATED APPLICATIONS

The present application is a continuation-in-part of co-pending U.S. application Ser. No. 12/333,174, filed Dec. 11, 2008, which is a continuation-in-part of co-pending U.S. application Ser. No. 12/040,969 filed Mar. 3, 2008. The entire disclosures of both of these applications are incorporated herein by reference.

FIELD OF THE INVENTION

The present invention relates to woodwind instruments and in particular to mouthpieces for woodwind instruments.

BACKGROUND OF THE INVENTION

Woodwind musical instruments, e.g., saxophones and clarinets, and other devices such as bird calls utilize the vibration of a reed in response to a flow of air to generate a tone. These reeds include natural cane reeds and synthetic reeds. Tone generation in general depends on proper reed vibration. The reed is typically placed in contact with a mouthpiece to cover an opening or window. The reed is held in place by an adjustable clamp or ligature that surrounds the mouthpiece and the reed. Variations in the mouthpiece and ligature affect the vibration of the reed and, therefore, the performance or tone of the device or instrument. Various ligatures have been proposed largely to improve the overall performance of the instrument.

In any device that is part of a vibrating system, differences in materials and construction yield different vibrational patterns and tonal spectrums. In a typical prior art ligature, the configuration was premised largely on the objective of permitting the reed to vibrate with greater freedom and less constriction. In U.S. Pat. No. 5,998,715, the tone is altered in accordance with user preference by alternating the weight of the cradle that interfaced the reed. This arrangement demonstrated that variations in the mass of the ligature construction influence the performance of the ligature. However, the arrangement was complex in that the fastening elements at the end of the body were not utilized effectively in mass-loading the ligature in the region of the reed.

SUMMARY OF THE INVENTION

The present invention is directed to ligatures and mouthpiece systems utilizing these ligatures that provide for increased performance in a woodwind instruments through the reduction of interfering vibrational frequencies from the ligature. A ligature is provided that includes a strap or body made of any suitable material, for example sheet metal, a rubberized fabric sheet or sheet plastic. The unitary strap encircles the mouthpiece and reed, and the ends of the strap terminate in relatively large masses that are in the form of cylindrical rods. An overlap or reverse bend is configured adjacent to each rod, and the ends of the ligature are affixed to the rods by suitable means. Preferably, the overlapped ends of the strap are crimped into slots in the rods. For metallic straps, a small cushion made of a resilient material, such as rubber, is located within the slots between the layers of overlapped strap. When the strap is fabric, a resilient metal shim is located between the overlapping layers in the slot.

A plurality of parallel slots or slits are incorporated into the strap adjacent the ends in of the reverse bend. A fastening or closure mechanism is provided that passes through holes in each rod to permit affixing the ligature to the reed and mouthpiece. When the ligature is assembled to the mouthpiece and reed, the inner surface of the ligature body presses on the reed in a highly compliant manner as a result of the tightening pressure exerted upon the cushion and the ligature body by the rods. The relatively heavy rods in conjunction with the compliance features lower the frequency band of the internal resonances of the ligature, improving the tonal quality, playing freedom, intonation, and response of the instrument.

In accordance with one embodiment, the present invention is directed to a ligature for a mouthpiece. The ligature includes a loop made from a thin resilient flexible strap having two ends. The loop is sized to encircle a mouthpiece. A mass is attached to the strap and has a sufficient weight to lower passband frequencies of internal resonances of the ligature sufficiently below passband frequencies of a vibrating reed secured to the mouthpiece by the ligature. In one embodiment, the mass is disposed on at least one of the two ends of the strap. Alternatively, the mass is two substantially equal masses, and each one of the two masses is attached to one of the two ends of the strap. Suitable shapes for the masses include cylindrical rods.

In one embodiment, the strap further has two parallel sides running between the two ends, and each cylindrical rod is aligned along each end to intersect each one of the two parallel sides at an angle other than 90° to create a frusto-conical shaped loop that accommodates a tapered mouthpiece. In one embodiment, each mass further includes a slot, and the corresponding end of the strap attached to each mass is disposed and securely anchored in the slot. In one embodiment, the strap is made from a rubberized fabric, and each end of the strap includes an overlapping fold forming two layers of the strap. Both of the layers are disposed within the slot. A metal shim can be provided between the two layers of the strap at each end of the strap. In another embodiment, the strap is a metal strap, and each end of the strap includes an overlapping fold forming two layers of the strap. Both layers disposed within the slot. A strip of rubberized fabric can be provided between the two layers of the strap at each end of the strap.

In one embodiment, each mass is a cylindrical rod, and each slot extends along an entire length of the cylindrical rod and partially into the cylindrical rod along a non-diametric secant line. The ends of the strap are disposed over the reed when the ligature is attached to the mouthpiece, and the non-diametric secant line intersects a plane tangent to the outer surface of the reed at a point between the two ends of the ligature at an angle of from about 40° to about 45°.

The present invention is also directed to a woodwind mouthpiece system that includes a mouthpiece, a reed in contact with the mouthpiece and a ligature surrounding the mouthpiece and the reed to secure the reed to the mouthpiece. The ligature includes a loop of a thin resilient flexible strap having two ends. The loop encircles the mouthpiece, and the ends of the strap are disposed over the reed. The mouthpiece system also includes two substantially equal masses. Each mass is attached to one of the ends of the strap and is spaced from the reed. The two masses in combination provide enough weight to lower passband frequencies of internal resonances of the ligature sufficiently below passband frequencies of the reed when vibrating.

In one embodiment, each mass further includes a slot running along its length. The corresponding end of the strap attached to each mass is disposed and securely anchored in the slot. In one embodiment, the strap is a rubberized fabric, and each end of the strap includes an overlapping fold forming two layers of the strap. Both layers are disposed within the slot, and a metal shim can be provided between the two layers of the strap at each end of the strap. In one embodiment, the strap is metal, and each end of the strap includes an overlapping fold forming two layers of the strap. Both layers are disposed within the slot, and a strip of rubberized fabric is disposed between the two layers of the strap at each end of the strap. In one embodiment, each mass is a cylindrical rod, and each slot extends along an entire length of the cylindrical rod and partially into the cylindrical rod along a non-diametric secant line. The ends of the strap are disposed over the reed when the ligature is attached to the mouthpiece, and the non-diametric secant line intersects a plane tangent to the outer surface of the reed at a point between the two ends of the ligature at an angle of from about 40° to about 45°.

In accordance with one exemplary embodiment, the present invention is directed to a ligature for a mouthpiece that includes a loop sized to encircle a mouthpiece. The loop is constructed of a single layer of resilient flexible strap having two opposing ends and two opposing parallel sides. In one embodiment, the flexible strap is constructed of rubberized fabric. The two opposing parallel sides include a first side having a first length and a second side having a second length. The second length is greater than the first length. In addition, the loop includes a plurality of slits extending partially across the flexible strap from either end of the flexible strap parallel to the sides of the flexible strap. In one embodiment, each one of the plurality of slits is spaced from a respective end of the flexible strap and extends across the flexible strap a distance of from about ¾ of an inch to about 1 inch.

The ligature also includes a pair of rigid bars. Each bar is attached to one of the opposing ends of the flexible strap and extends between the opposing parallel sides. In one embodiment, each rigid bar is a cylindrical rod having a diameter of about ¼ of an inch, and the flexible strap has a thickness of about 1/32 of an inch. In one embodiment, each rigid bar is a cylindrical rod, and each cylindrical rod has a slot extending partially into the cylindrical rod and running along a length of the cylindrical rod. A corresponding end of the single layer flexible strap is disposed and anchored in the slot. Each cylindrical rod further also includes a hole passing completely through the cylindrical rod. Each slot extends diametrically into the cylindrical rod along a first diameter, and each hole passes diametrically through the cylindrical rod along a second diameter. In one embodiment, the first diameter is perpendicular to the second diameter. Alternatively, the first diameter intersects the second diameter at an angle that deviates from perpendicular by up to about 7 degrees.

In one embodiment, each cylindrical rod is aligned along each end to intersect each one of the two opposing parallel sides at an angle other than 90° to create a frusto-conical shaped loop that accommodates for a tapered mouthpiece. In one embodiment, each cylindrical rod further includes a flat region running the length of the cylindrical rod and extending from one side of the slot partially around the circumference of the cylindrical rod. The flat regions are disposed in the interior of the loop. In one embodiment, the flexible strap includes a first side having a rough texture and a second side having a smooth texture. The first side forms an inner surface of the loop, and the second side forms an outer surface of the loop.

The present invention is also directed to a ligature for a mouthpiece that includes a loop sized to encircle a mouthpiece and constructed from a resilient flexible strap, e.g., a rubberized fabric strap, having two opposing ends and two opposing parallel sides. The ligature also includes a u-shaped cradle constructed from a flexible, resilient material, e.g., spring steel. The cradle is attached to the flexible strap between the two opposing ends and is disposed within an interior of the loop. The ligature also includes a pair of rigid bars. Each bar is attached to one of the opposing ends of the flexible strap and extends between the opposing parallel sides.

In one embodiment, the cradle includes a central portion in contact with the flexible strap and a pair of wings extending from the central portion to form the u-shape. The wings extend from the central portion so as to form an angle of from about 30 degrees to about 50 degrees with the flexible strap, when the flexible strap is positioned flat in a single plane. In one embodiment, each wing includes a plurality of parallel slits. The parallel slits arranged parallel to the opposing sides of the flexible strap. In one embodiment, the parallel slits are spaced apart by a variable distance that increases when moving along each wing from a first parallel side to a second parallel side. This variable distance increases from about 1/10 of an inch to about 2/10 of an inch. Preferably, the parallel slits do not extend into the central portion or into edges of the wings, and each slit has a length of about ⅜ of an inch. In one embodiment, the flexible strap has a first side having a rough texture and a second side having a smooth texture. The first side forms an inner surface of the loop, and the second side forms an outer surface of the loop. The cradle is attached to the first side. In one embodiment, the cradle is rectangular and has a size of about 1 inch by about 1 inch.

The present invention is also directed to a woodwind mouthpiece system that includes a mouthpiece, a reed in contact with the mouthpiece and a ligature surrounding the mouthpiece and the reed to secure the reed to the mouthpiece. Suitable ligatures include any of the ligatures in accordance with the present invention.

In accordance with one exemplary embodiment, the present invention is directed to a ligature for a mouthpiece having a loop sized to encircle a mouthpiece. This loop includes a single layer of resilient flexible strap having two opposing ends and two opposing parallel sides. The two opposing parallel sides include a first side having a first length and a second side having a second length, the second length greater than the first length. The loop also includes a plurality of slits extending partially across the flexible strap from either end of the flexible strap parallel to the sides of the flexible strap. The parallel slits do not extend completely across the flexible strap, and a space exists between the parallel slits extending from opposite ends of the flexible strap. This space is about 6% to about 7% of the entire length either the first length or the second length. In one embodiment, the space has a length of about ¼ of an inch. In one embodiment, each one of the plurality of slits is spaced from a respective end of the flexible strap and extends across the flexible strap a distance of from about ¾ of an inch to about 1 inch.

In one embodiment, for example where the flexible strap is a metal strap, the slits are slots, and the flexible strap includes a plurality of slots extending partially across the flexible strap from either end of the flexible strap parallel to the sides of the flexible strap. The space between parallel slots extending from opposite ends of the flexible strap is about 16% to about 17.5% of the entire length of either the first length or the second length. In one embodiment, the space has a length of ½ inches or 9/16 inches.

The ligature also includes a pair of rigid bars. Each bar is attached to one of the opposing ends of the flexible strap and extends between the opposing parallel sides. In one embodiment, each rigid bar is a cylindrical rod having a diameter of about ¼ of an inch, and the flexible strap has a thickness of about 1/32 of an inch. In one embodiment, each rigid bar is a cylindrical rod, and each cylindrical rod has a slot extending partially into the cylindrical rod and running along a length of the cylindrical rod. A corresponding end of the single layer flexible strap is disposed and anchored in the slot. In on embodiment, each cylindrical rod includes a hole passing completely through the cylindrical rod.

Each slot extends diametrically into the cylindrical rod along a first diameter, and each hole passes diametrically through the cylindrical rod along a second diameter. The first diameter is perpendicular to the second diameter. In one embodiment, each slot extends diametrically into the cylindrical rod along a first diameter, and each hole passes diametrically through the cylindrical rod along a second diameter. The first diameter intersects the second diameter at an angle that deviates from perpendicular by up to about 7 degrees.

In one embodiment, each cylindrical rod is aligned along each end to intersect each one of the two opposing parallel sides at an angle other than 90° to create a frusto-conical shaped loop that accommodates for a tapered mouthpiece.

In one embodiment, the flexible strap is a rubberized fabric. The flexible strap includes a first side having a rough texture and a second side having a smooth texture. The first side makes up an inner surface of the loop, and the second side makes up an outer surface of the loop. In one embodiment, each cylindrical rod also includes a flat region running the length of the cylindrical rod and extending from one side of the slot partially around the circumference of the cylindrical rod. The flat regions are disposed in the interior of the loop.

The present invention is also directed to a ligature for a mouthpiece. This ligature includes a loop of a thin resilient flexible strap having two ends. The loop is sized to encircle a mouthpiece. A pair of rigid bars is provided such that each bar attached to one of the ends of the flexible strap. A pair removable masses is attached to the removable strap. Each removable mass is in contact with one of the rigid bars, and the pair of removable masses in combination adds sufficient weight to the ligature to lower passband frequencies of internal resonances of the ligature sufficiently below passband frequencies of a vibrating reed secured to the mouthpiece by the ligature.

In one embodiment, the pair of removable masses are identical masses. Each removable mass has a cavity having a shape that accommodates one of the rigid bars. The rigid bar is disposed in the cavity when the removable mass is attached to the flexible strap. When each rigid bar is a cylindrical rod with rounded ends, the cavity in each removable mass has a curved pocket with curved ends. Each rigid bar and each removable mass includes a single through hole. All of the through holes of the rigid bars and removable masses are aligned when the removable masses are attached to the flexible strap. A threaded rod passes completely through all of the through holes, and a thumbscrew is attached to a distal end of the threaded rod. The threaded rod and thumbscrew secure the removable masses to the flexible strap.

DETAILED DESCRIPTION

Figure 1:
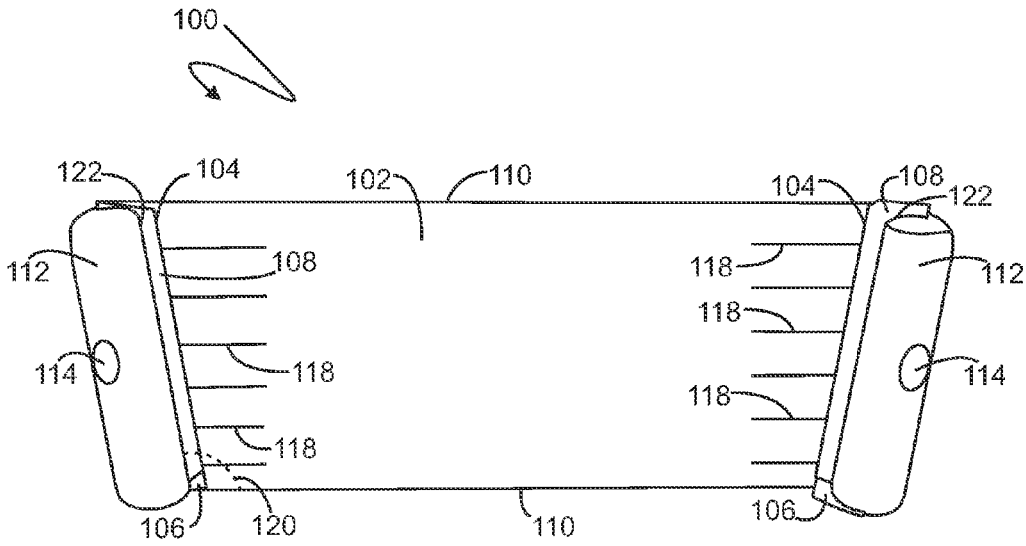
FIG. 1 is a plan view of a first side of an embodiment of a ligature in accordance with the present invention.
Figure 2:
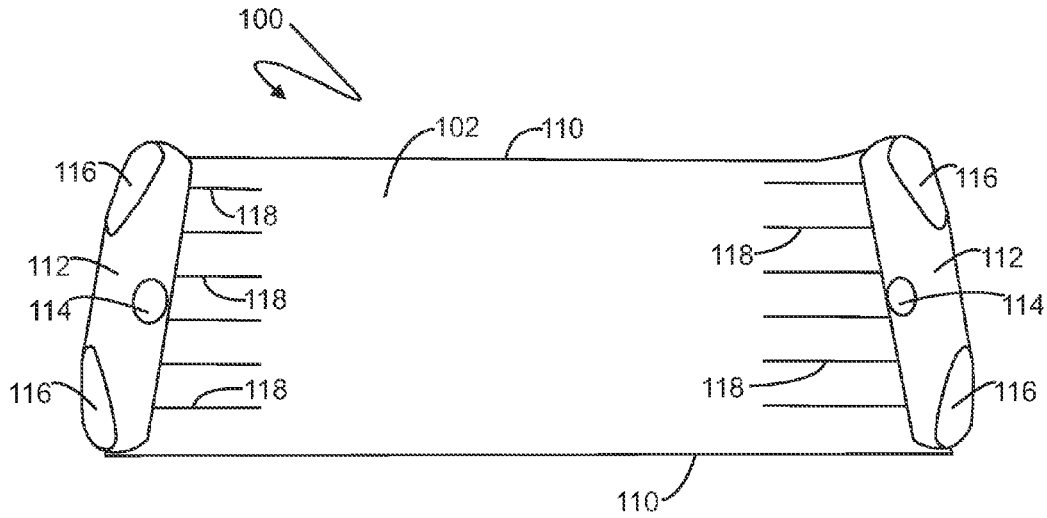
FIG. 2 is a plan view of a second side of the ligature of FIG. 1.

Referring initially to FIGS. 1 and 2, an exemplary embodiment of a ligature 100 in accordance with the present invention is illustrated. The ligature is used to secure reeds to a mouthpiece for use with a woodwind instrument, e.g., a single reed woodwind instrument such as a clarinet or saxophone, or any other type of device where a vibrating reed is secured to a mouthpiece. The ligature includes a thin resilient flexible strap 102 having two opposite ends 104. As illustrated, the thin flexible strap is generally rectangular in shape; however, the strap can be other shapes including square, circular or trapezoidal. The strap is sized in accordance with the size of the mouthpiece to which the ligature is applied. In one embodiment, the flexible strap is about 1" to about 1.25" wide and about 3.0" or 3.5" to about 4" long. In one embodiment, the flexible strap has a thickness of about 0.035". Preferably, the width of the ligature strap is selected to span as much of the length of the reed as practical to decrease the unit pressure exerted by the strap in contact with the reed. A decrease in unit contact pressure on the reed allows the reed to vibrate more freely. Suitable materials for the flexible strap include, but are not limited to polymers, elastomers, metals and combinations thereof. As illustrated in FIGS. 1 and 2, the flexible strap is a rubberized fabric sheet. The flexible strap can be formed into a loop by bringing the two ends together. The loop is sized to encircle a mouthpiece. In one embodiment, at either end of the flexible strap is a plurality of generally parallel slits 118. Each slit runs from one of the ends a given distance into the strap in a direction that is generally parallel to the two parallel sides 110 of the flexible strap. As illustrated, each end contains six slits. The slits contribute additional compliance or form-fitting flexibility to the strap to enhance the function of the ligature. The number of slits provided on each end can be varied depending on the amount of compliance desired or required.

In one embodiment, the ligature includes at least one mass 112 attached along the strap. Alternatively, a plurality of masses is attached along the flexible strap. Preferably, the ligature includes two masses. In one embodiment, the masses are substantially equal. The mass or combination of masses, in combination with the high compliance construction of the ligature strap, provides sufficient weight to the ligature to lower the passband frequencies of internal resonances of the ligature sufficiently below passband frequencies of the vibrating reed that is secured to the mouthpiece by the ligature. In general, the weight of the mass is significantly more than the weight of the flexible strap. In one embodiment, the ligature contains one mass attached to at least one of the ends of the flexible strap. In another embodiment, the ligature includes two masses, each attached to one of the ends, i.e., opposite ends, of the flexible strap.

Suitable materials for the mass include any material that can produce an adequate amount of weight to achieve the desired passband frequency reduction within the space constraints of a mouthpiece. Preferably, the mass is metal. Suitable metals include, but are not limited to, copper, brass and stainless steel. In one embodiment, each mass is constructed from cylindrical bar stock having a diameter of from about 0.25" to about 0.5" and preferably about 0.375". The length of each cylindrical mass is from about 1" to about 1.5" and preferably about 1.25". The mass can also be a rectangular or square rod or any other elongated shape. In one embodiment, each mass includes at least one diametric hole 114 disposed along the length of the cylindrical mass. When one diametric hole is included in each mass, the hole is located generally at the midpoint along the length of the cylindrical mass. In one embodiment, each hole has a diameter of about 0.15". In one embodiment, both ends of each mass include tapers 116, cutouts, bevels or chamfers. These two tapers can be used to adjust, i.e., remove, mass. In addition, the tapers provide clearance for the chin of a user when the ligature is attached a mouthpiece. In one embodiment, all of the masses are identical in size, weight and configuration. Since a mass may have to be rotated 180° depending on the end of the flexible strap to which it is attached, having identical tapers on either end of each mass facilitates placement of any given mass on either end of a flexible strap.

Each mass can be fixedly or removable secured to a given end of the flexible strap. Having masses removably attached facilitates exchanging or replacing masses. Preferably, each mass is fixedly secured to a given end of the flexible strap. Suitable attachment mechanisms include, but are not limited to, fasteners such as rivets and adhesives. In one embodiment, a slot 122, having for example a "U" shaped or rectangular cross section, is provided along the length of each mass. Each slot can extend either partially or entirely along the length of each mass and extends into the mass, for example either diametrically or non-diametrically. In one embodiment, each slot has a depth that extends partially into the cylindrical rod along a non-diametric secant line.

The ends of the flexible strap are inserted into the slot, and the mass is crimped closed on the strap, securely anchoring the strap into the mass. In this embodiment, the material of the strap provides the desired cushioning and vibrational isolation or dampening between each mass and the mouthpiece to which the ligature is attached. In one embodiment, an overlap 108 is provided at each end to form two layers of the flexible strap that are inserted into the slot. Overlapping increases the level of cushioning as well as the stability of the bond between the mass and the strap. In addition, a rigid insert 106 is provided between the overlapping layers at the ends of the flexible strap. The rigid insert also improves the stability of the attachment between the flexible strap and the mass. Suitable materials for the rigid insert include rigid plastics and metals including brass and stainless steel. In one embodiment, the rigid insert is a metal shim having a thickness of less than about 0.0625" and preferably about 0.01". Although each mass can be attached to the flexible strap so that the mass intersects the sides 110 of the flexible strap at an angle 120 of about 90°, preferably the mass, i.e., the long axis of the cylindrical rod from which the mass is created, is aligned along each end to intersect each one of the two parallel sides at an angle 120 other than 90°. This creates a loop having a frusto-conical shape that accommodates a tapered mouthpiece.

Figure 3:
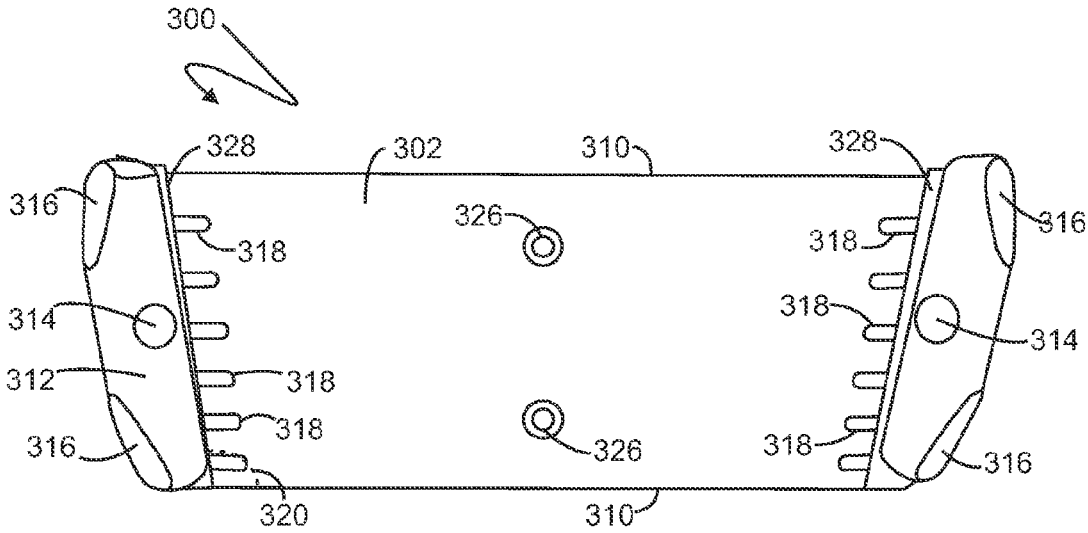
FIG. 3 is a plan view of a first side of another embodiment of a ligature in accordance with the present invention.
Figure 4:
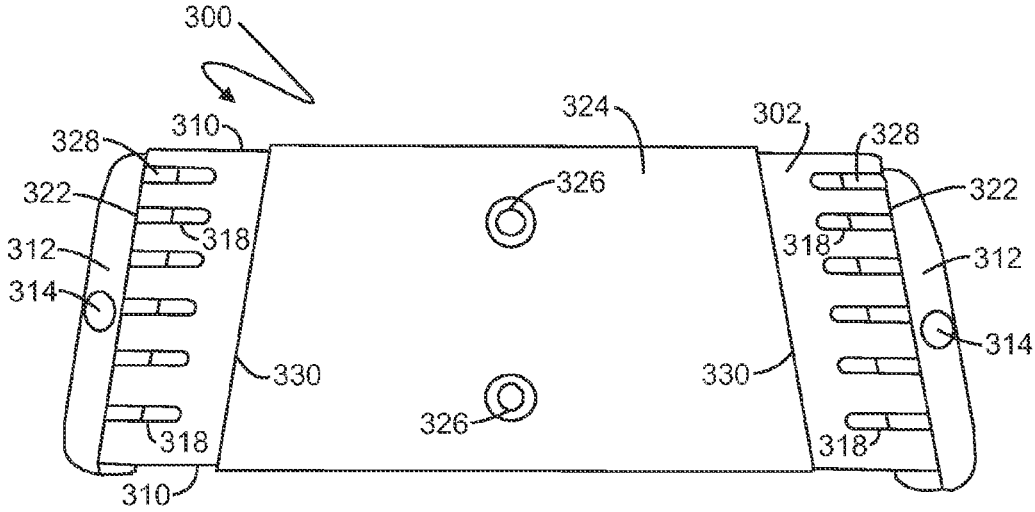
FIG. 4 is a plan view of a second side of the ligature of FIG. 3.

Referring to FIGS. 3 and 4, an exemplary embodiment of the ligature 300 of the present invention is illustrated, where the flexible or bendable strap 302 is thin metal. Suitable metals include copper, brass and stainless steel. As illustrated, the thin flexible strap is generally rectangular in shape; however, the strap can be other shapes including square, circular or trapezoidal. The strap is sized in accordance with the size of the mouthpiece to which the ligature is applied. In one embodiment, the flexible strap is about 1" to about 1.25" wide and about 3.5" to about 4" long. In one embodiment, the flexible strap has a thickness of about less than about 0.0625" and preferably about 0.01". The flexible strap can be formed into a loop by bringing the two ends together. The loop is sized to encircle a mouthpiece. Attached to an inner surface of the flexible strap is a cushioning or vibration dampening material 324. Suitable materials include polymers, elastomers and rubberized fabrics. The cushioning material is fixedly secured to the flexible strap, for example using a plurality of rivets 326 and is positioned to be between the flexible strap and the mouthpiece. The cushioning material is as wide as the flexible strap, and the length is less than the length of the flexible strap with ends 330 that generally parallel the ends of masses 312 of the ligature.

At either end of the flexible strap is a plurality of generally parallel slots 318 that have been cut out of the flexible metallic strap. Each slot runs from one of the ends a given distance into the strap in a direction that is generally parallel to the two parallel sides 310 of the flexible strap. As illustrated, each end contains six slots. The slots contribute additional compliance or form fitting flexibility to the strap to enhance the function of the ligature. The number of slots provided on each end can be varied depending on the amount of compliance desired or required.

In one embodiment, the ligature includes at least one mass 312 attached along the strap. Alternatively, a plurality of masses is attached along the flexible strap. Preferably, the ligature includes two masses. In one embodiment, the masses are substantially equal. The mass or combination of masses provides sufficient weight to the ligature to lower the passband frequencies of internal resonances of the ligature sufficiently below passband frequencies of the vibrating reed that is secured to the mouthpiece by the ligature. In general, the weight of the mass is significantly more than the weight of the flexible strap. In one embodiment, the ligature contains one mass attached to at least one of the ends of the flexible strap. In another embodiment, the ligature includes two masses, each attached to one of the ends of the flexible strap.

Suitable materials for the mass include any material that can produce an adequate amount of weight to achieve the desired passband frequency reduction within the space constraints of a mouthpiece. Preferably, the mass is metal. Suitable metals include, but are not limited to, copper, brass and stainless steel. In one embodiment, each mass is constructed from cylindrical bar stock having a diameter of from about 0.25" to about 0.5" and preferably about 0.375". The length of each cylindrical mass is from about 1" to about 1.5" and preferably about 1.25". The mass can also be a rectangular or square rod or any other elongated shaped. In one embodiment, each mass includes at least one diametric hole 314 disposed along the length of the cylindrical mass. When one diametric hole is included in each mass, the hole is located generally at the midpoint along the length of the cylindrical mass. In one embodiment, each hole has a diameter of about 0.15". In one embodiment, both ends of each mass include tapers 316, cutouts, bevels or chamfers. These two tapers can be used to adjust, i.e., remove, mass. In addition, the tapers provide clearance for the chin of a user when the ligature is attached a mouthpiece. In one embodiment, all of the masses are identical in size, weight and configuration. Since a mass may have to be rotated 180° depending on the end of the flexible strap to which it is attached, having identical tapers on either end of each mass facilitates placement of any given mass on either end of a flexible strap.

Each mass can be fixedly or removably secured to a given end of the flexible strap. Having masses removably attached facilitates exchanging or replacing masses. Preferably, each mass is fixedly secured to a given end of the flexible strap. Suitable attachment mechanisms include, but are not limited to, fasteners such as rivets and adhesives. In one embodiment, a slot 322, having for example a "U" shaped or rectangular cross section, is provided along the length of each mass. Each slot can extend either partially or entirely along the length of each mass and extends into the mass, for example either diametrically or non-diametrically. In one embodiment, each slot has a depth that extends partially into the cylindrical rod along a non-diametric secant line.

The ends of the flexible strap are inserted into the slot, and the mass is crimped closed on the strap, securely anchoring the strap into the mass. In this embodiment, the material of the strap provides the desired cushioning and vibrational isolation or dampening between each mass and the mouthpiece to which the ligature is attached. In one embodiment, an overlap is provided at each end to form two layers of the flexible strap that are inserted into the slot. Overlapping increases the stability of the bond between the mass and the strap. In addition, a flexible insert 328 is provided between the overlapping layers at the ends of the flexible strap. Suitable materials for the flexible insert include polymers, elastomers and rubberized fabric. In one embodiment, the material of the flexible insert is the same as the material of the cushioning insert. In one embodiment, the flexible insert has a thickness of less than about 0.0625" and preferably about 0.035". Although each mass can be attached to the flexible strap so that the mass intersects the sides 310 of the flexible strap at an angle 320 of about 90°, preferably each mass, i.e., the cylindrical rod from which the mass is created, is aligned along each end to intersect each one of the two parallel sides at an angle 320 other than 90°. This creates a loop having a frusto-conical shape that accommodates for a tapered mouthpiece.

Figure 5:
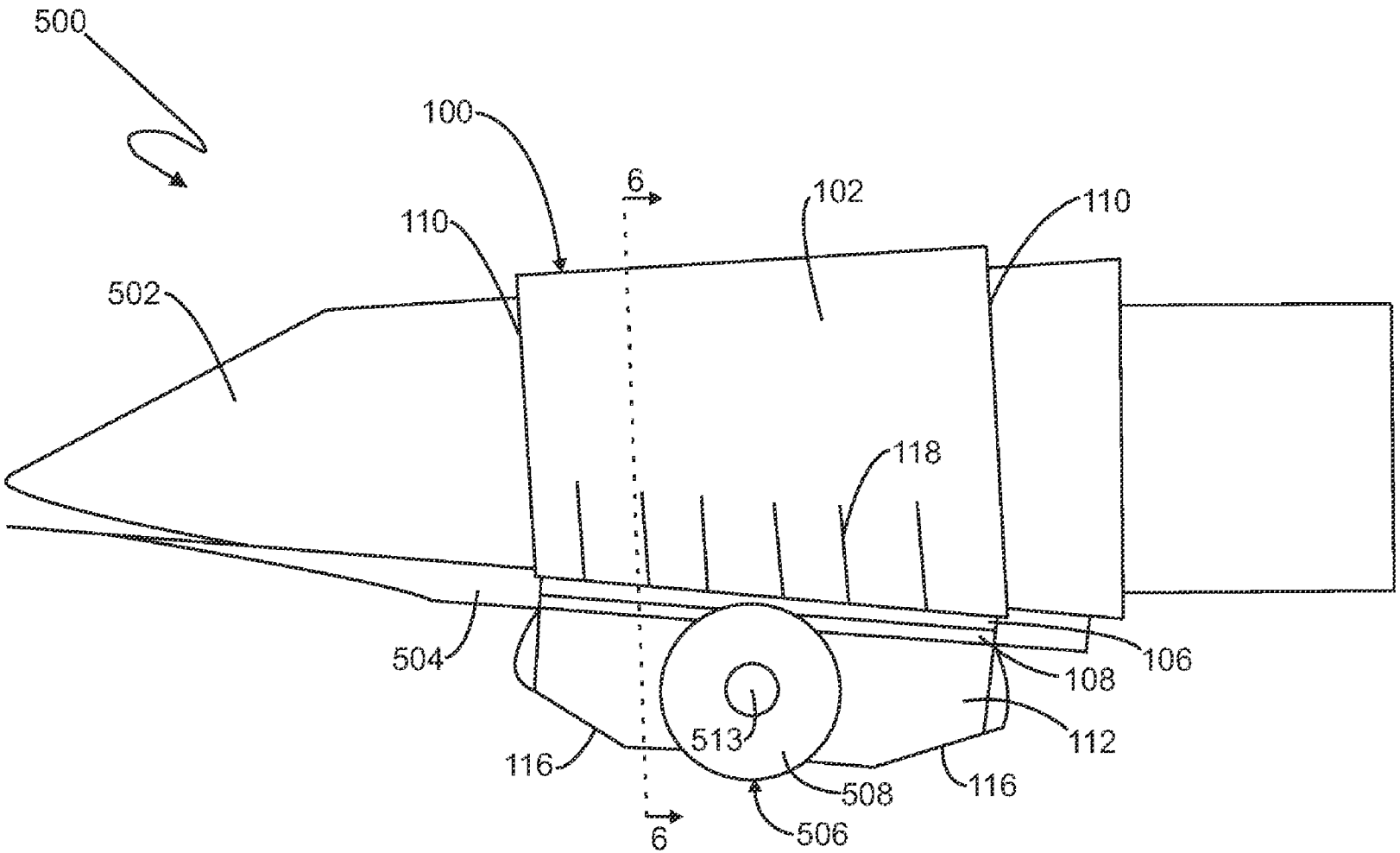
FIG. 5 is a side view of an embodiment of a mouthpiece system utilizing the ligature of FIG. 1.
Figure 6:
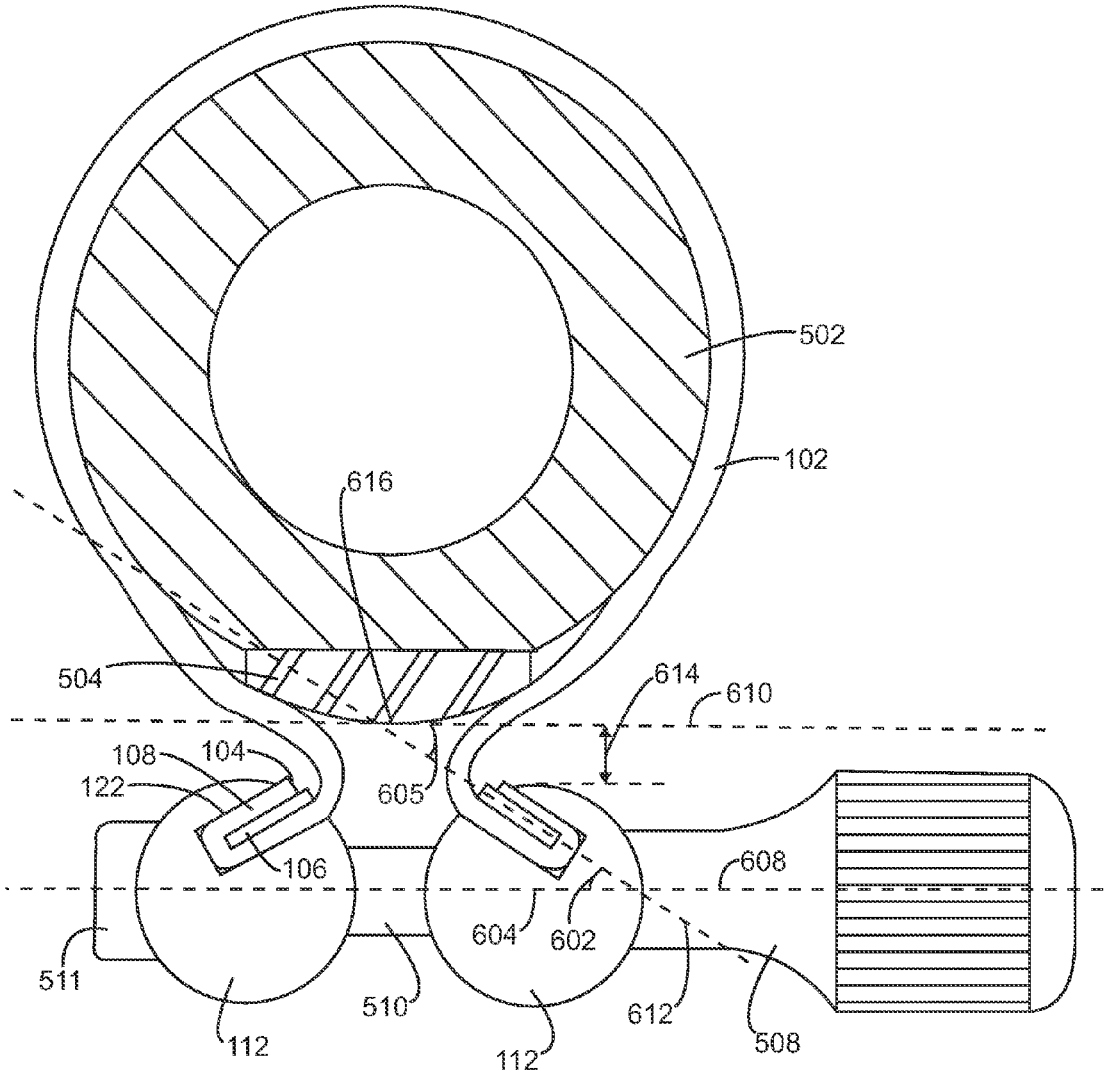
FIG. 6 is a view through line 6-6 of FIG. 5.

Referring to FIGS. 5 and 6, an exemplary embodiment of a woodwind mouthpiece system 500 utilizing the ligature in accordance with the present invention is illustrated. The system includes a mouthpiece 502, a reed 504 in contact with the mouthpiece and a ligature 100 surrounding the mouthpiece and the reed to secure the reed to the mouthpiece. In this embodiment, the ligature illustrated in FIGS. 1 and 2 is used. As illustrated, the ends of the flexible strap 102 are disposed over the reed 504 when the ligature 100 is attached to the mouthpiece 502. Therefore, each mass 112 is disposed generally adjacent the reed and spaced a given distance 614 from the reed by the flexible strap. Location of the mass adjacent the reed 504 dampens the vibration, i.e., the passband frequencies, of the flexible strap adjacent the reed. This prevents strap ligature vibrations from interfering with the vibration of the reed.

As is best illustrated in FIG. 6, the flexible strap forms a loop that encircles the mouthpiece 502 to secure the reed 504 to the mouthpiece. By drawing the masses and hence the ends of the flexible strap together, the strap tightens around the mouthpiece and the reed. As shown, each slot 122 within a given mass, extends into the mass partially along the non-diametric secant line 612. The non-diametric secant line does not pass through the center 604 of the circular cross section of the mass. In one embodiment, the secant line intersects a plane 610 tangent to the outer surface of the reed at a point 616 between the two ends or masses of the ligature at an angle 605 of from about 40° to about 45°. In one embodiment, the tangent point is disposed generally along the middle of the reed and preferably midway between the ends of the attached ligature. The non-diametric alignment in combination with the angle 605 translates the motion of bringing the ends and masses of the ligature together into both a constrictive force parallel to the plane 610 that tightens the flexible strap around the mouthpiece and a holding force perpendicular to the plane 610 that holds the reed against the mouthpiece.

The mouthpiece system includes a closure mechanism 506 that is in contact with and works in conjunction with the ligature to draw the ends and masses of the ligature together to tighten the ligature around the mouthpiece. In one embodiment, the closure mechanism is considered part of the ligature. Suitable closure mechanisms include clamps and threaded fasteners. Preferably, the closure mechanism is a threaded rod 510 that is passed through the holes 114 in each mass. The threaded rod has a head 511 that is larger than the diameter of the hole and threads along the distal end 513 to which a threaded thumbscrew or thumbnut 508 is attached. By turning the thumb screw in the proper direction, the masses are drawn together, applying a force that is decomposed into the constrictive force and perpendicular force and that tightens the ligature. In one embodiment, the alignment of the holes with respect to the slots 122 in conjunction with the closure mechanism function to define and to hold the angle 605 of the secant line with respect to the plane 610. Each hole 114 passes through the center 604 of the mass, and an angle 602 is defined between the center line 608 of the hole and the secant line 612 associated with the slot. This angle is the same as the angle 605 between the plane 610 and the secant line. Therefore, by establishing the hole and slot, the desired relationship between the masses, the flexible strap and the reed is established. In addition, the non-diametric alignment minimizes the amount of the ligature strap, either metal or flexible, that has to be cut or removed for the diametric hole that passes through each mass. Since the width of the ligature is selected to span as much of the length of the reed, preferably, the ligature is controlled along the entire width, i.e., the entire width contained within the slot. Therefore, any breaks in the contact between the ligature and the mass, for example the cut-outs required by the diametric mass holes, are minimized. Preferably, the breaks are limited to less than about 18% of the entire width of the ligature strap. In addition, the alignment and angle of the slot and hole form a bend in the ligature strap that spaces the masses from the reed and that function as an additional cushioning element between the masses and the reed.

Figure 7:
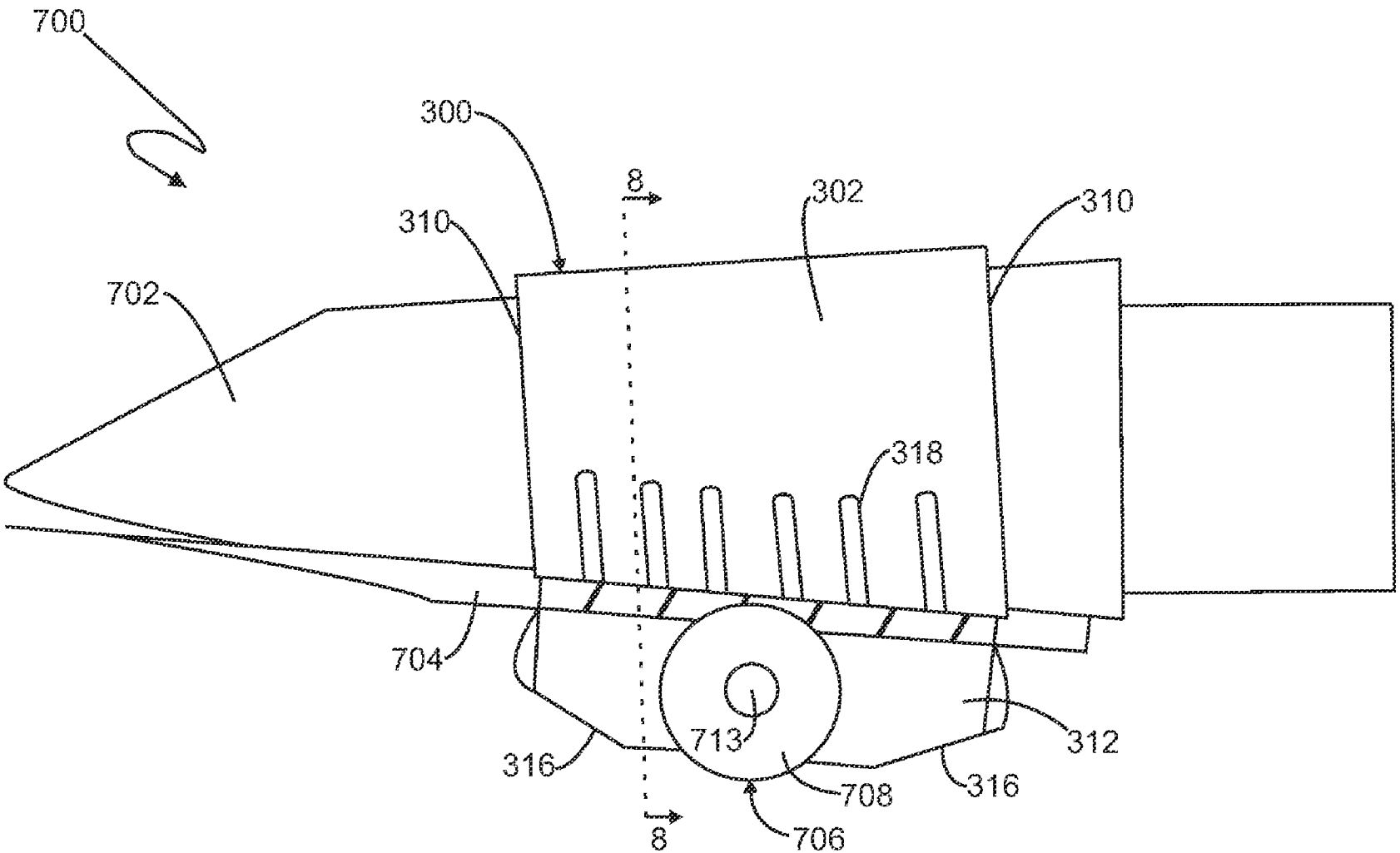
FIG. 7 is a side view of another embodiment of a mouthpiece system utilizing the ligature of FIG. 3.
Figure 8:
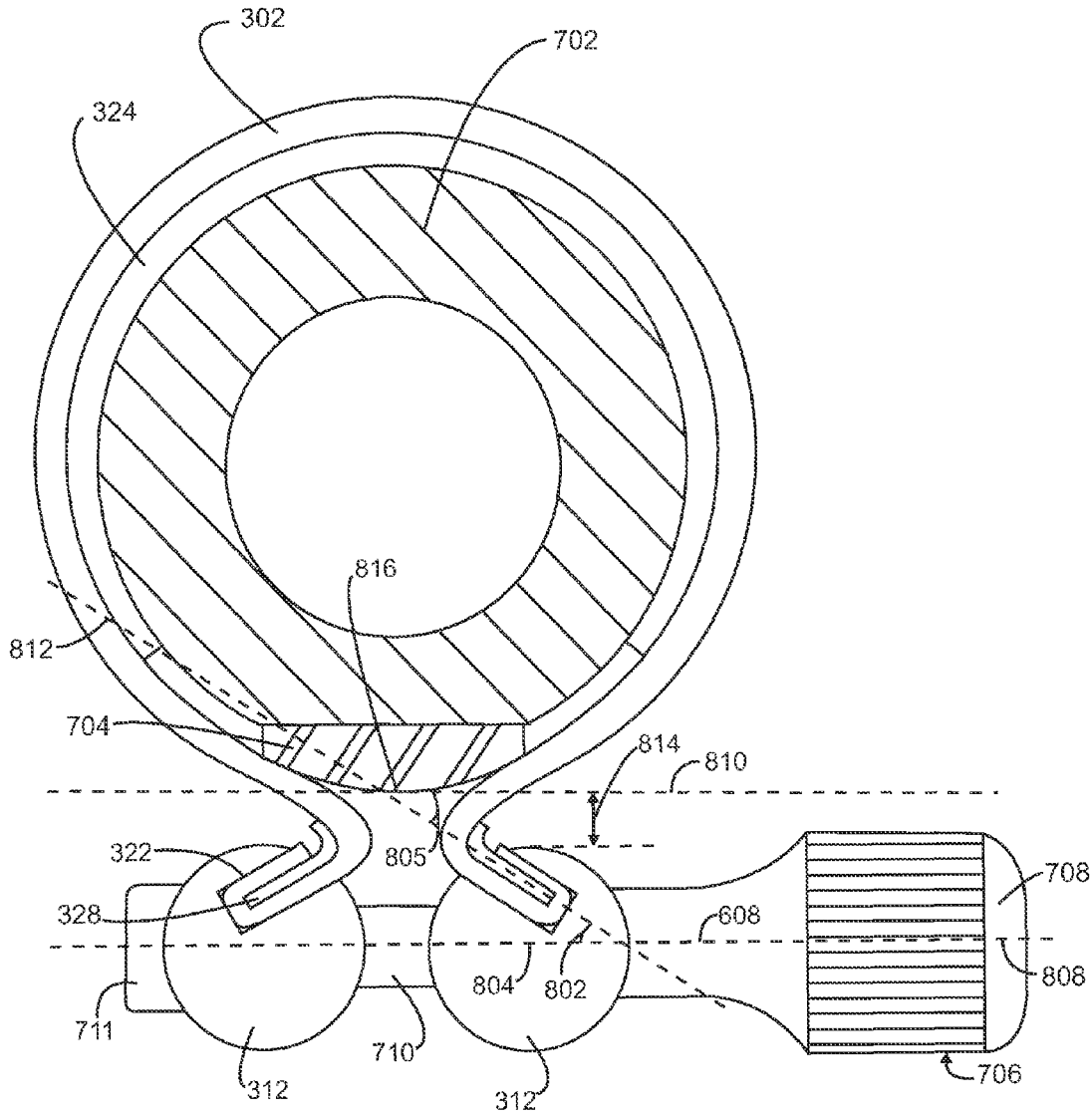
FIG. 8 is a view through line 8-8 of FIG. 7.
Figure 9:
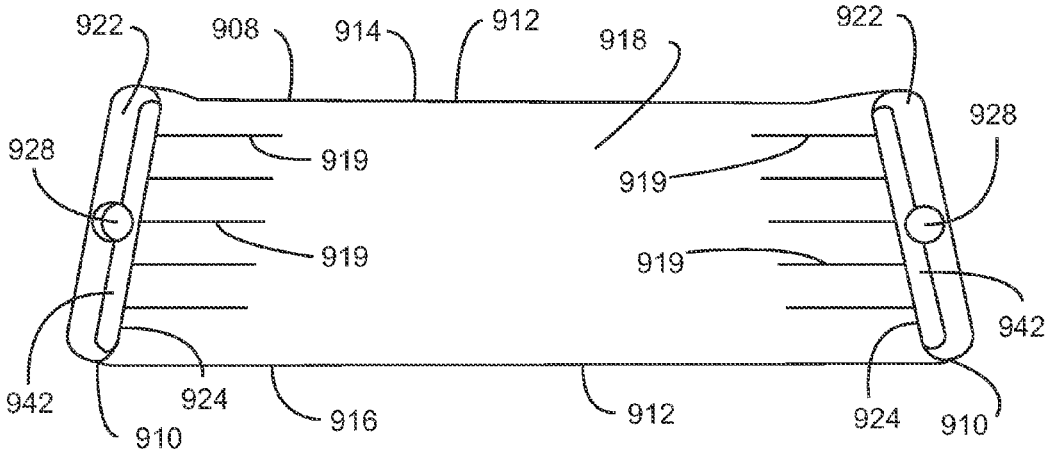
FIG. 9 is a plan view of a first side of another embodiment of a ligature in accordance with the present invention.
Figure 10:
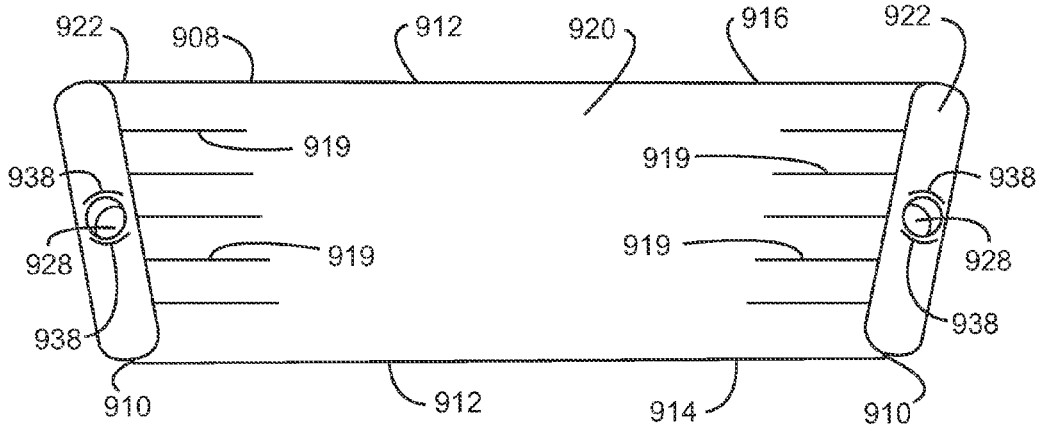
FIG. 10 is a plan view of a second side of the ligature of FIG. 9.
Figure 11:
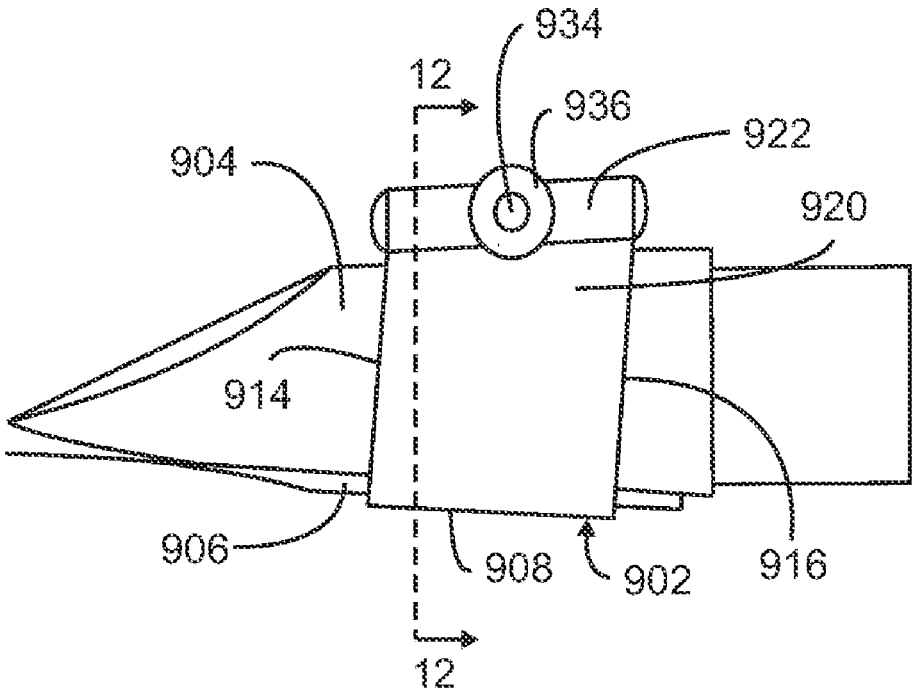
FIG. 11 is a side view of an embodiment of a mouthpiece system utilizing the ligature of FIG. 9.
Figure 12:
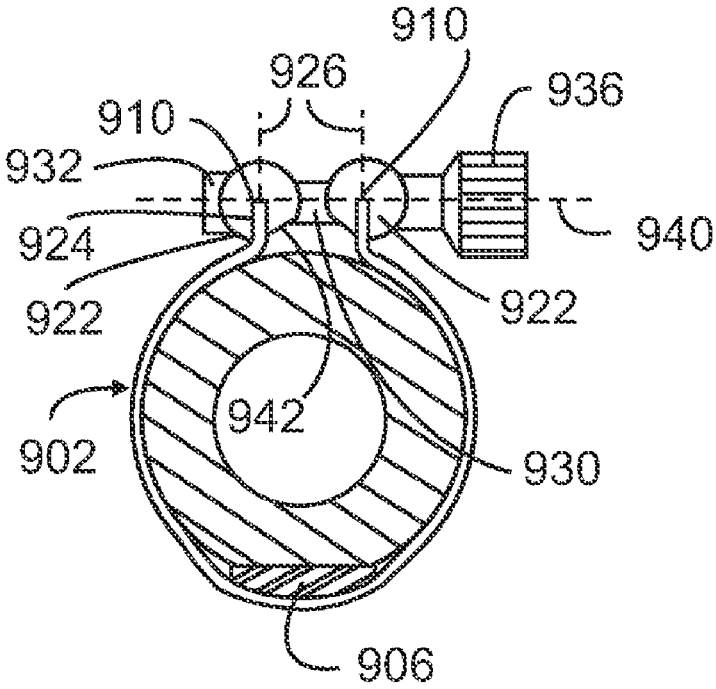
FIG. 12 is a view through line 12-12 of FIG. 11.

Referring to FIGS. 7 and 8, an exemplary embodiment of a woodwind mouthpiece system 700 utilizing the ligature in accordance with the present invention is illustrated. The system includes a mouthpiece 702, a reed 704 in contact with the mouthpiece and a ligature 300 surrounding the mouthpiece and the reed to secure the reed to the mouthpiece. In this embodiment, the ligature illustrated in FIGS. 3 and 4 is used. As illustrated, the ends of the flexible strap 302 are disposed over the reed 704 when the ligature 300 is attached to the mouthpiece 702. Therefore, each mass 312 is disposed generally adjacent the reed and spaced a given distance 814 from the reed by the flexible strap. Location of the mass adjacent the reed 704 in combination with the flexible insert 328 dampens the vibration, i.e., the passband frequencies, of the flexible strap adjacent the reed. This prevents strap ligature vibrations from interfering with the vibration of the reed.

As is best illustrated in FIG. 8, the flexible strap forms a loop that encircles the mouthpiece 702 to secure the reed 704 to the mouthpiece. By drawing the masses and hence the ends of the flexible strap together, the strap tightens around the mouthpiece and the reed. As shown, each slot 322 within a given mass, extends into the mass partially along the non-diametric secant line 812. The non-diametric secant line does not pass through the center 804 of the circular cross section of the mass. In one embodiment, the secant line intersects a plane 810 tangent to the outer surface of the reed at a point 816 between the two ends or masses of the ligature at an angle 805 of from about 40° to about 45°. In one embodiment, the tangent point is disposed generally along the middle of the reed and preferably midway between the ends of the attached ligature. The non-diametric alignment in combination with the angle 805 translates the motion of bringing the ends and masses of the ligature together into both a constrictive force parallel to the plane 810 that tightens the flexible strap around the mouthpiece and a holding force perpendicular to the plane 810 that holds the reed against the mouthpiece.

The mouthpiece system includes a closure mechanism 706 that is in contact with and works in conjunction with the ligature to draw the ends and masses of the ligature together to tighten the ligature around the mouthpiece. In one embodiment, the closure mechanism is considered part of the ligature. Suitable closure mechanisms include clamps and threaded fasteners. Preferably, the closure mechanism is a threaded rod 710 that is passed through the holes 314 in each mass. The threaded rod has a head 711 that is larger than the diameter of the hole and threads along the distal end 713 to which a threaded thumbscrew or thumbnut 708 is attached. By turning the thumbscrew in the proper direction, the masses are drawn together, applying a force that is decomposed into the constrictive force and perpendicular force and that tightens the ligature. In one embodiment, the alignment of the holes with respect to the slots 322 in conjunction with the closure mechanism function to define and to hold the angle 805 of the secant line with respect to the plane 810. Each hole 314 passes through the center 804 of the mass, and an angle 802 is defined between the center line 808 of the hole and the secant line 812 associated with the slot. This angle is the same as the angle 805 between the plane 810 and the secant line. Therefore, by establishing the hole and slot, the desired relationship between the masses, the flexible strap and the reed is established.

The ligature of the present invention for affixing the reed to the mouthpiece of a saxophone or clarinet utilizes both heavy weighting and compliance elements to subdue the effect of internal resonances in the ligature, thereby improving the performance of the mouthpiece system. The mass-loading is as fully implemented as is practicable, and the arrangement of the ligature is simpler and more cost effective. The mass loading lowers the passband frequencies of the internal resonances of the ligature well below the passband frequencies of the reed when the instrument is being played, eliminating any tendency of the ligature resonances to counter the vibration of the reed. The result is a tonality of greater depth and greater musicality in combination with a decrease in any tendency to deviate from accuracy of intonation.

When the elements of the ligature that provide the compliant interface with the reed are backed by weighted elements, the negative effects of the high compliance are completely mitigated, and the player experiences complete control of the instrument's performance. By fastening the body of the ligature into a fold-back that partially encloses a spring-like cushion, an extremely compliant interface with the reed is achieved. The ends of the body are terminated into large, weighted rods, into which fastening means are incorporated.

In accordance with another exemplary embodiment, the present invention is directed to a ligature for a mouthpiece and a mouthpiece system that yields a high level of playing performance at a relatively low cost. Ligatures in accordance with this embodiment can be made using a minimum amount of materials and a minimum amount of manufacturing labor. Referring to FIGS. 9-12, the ligature includes a loop 902 sized to encircle a mouthpiece 904 and reed 906 and to secure the reed 906 to the mouthpiece 904. The loop 902 is constructed from a single layer of a resilient, flexible strap 908 that has two opposing ends 910, and two opposing parallel sides or edges 912. The two opposing parallel sides include a first side 914 having a first length, i.e., from end to end, and a second side 916 having a second length. In one embodiment, the second length is greater than the first length. Therefore, the flexible strap, when formed into the loop has a frusto-conical shape that accommodates the taper on the mouthpiece.

Suitable materials for the flexible strap are described above. Preferably, the flexible strap is a rubberized fabric. In one embodiment, the flexible strap has a thickness of less than about ⅛ of an inch, for example about 1/16 of an inch and preferably about 1/32 of an inch. In one embodiment, the flexible strap has a thickness of about 0.01 inches. Therefore, the thickness of the flexible strap is consistent with the thickness of conventional metal ligatures that are provided with the single-reed woodwind mouthpieces. In addition, the single-reed woodwind mouthpieces are provided with a cap that completely covers the mouthpiece, reed and ligature to protect the reed from damage during storage and transport. Since the flexible strap of the present embodiment is provided as a single layer in a comparable thickness to the conventional metal ligature, a conventional cap can be used with the ligature of the present invention, eliminating the cost associated with purchasing a special, larger cap. Therefore, the ligature of the present embodiment can be simply substituted for conventional ligatures and provides the enhanced tonal qualities associated with using the flexible strap ligature.

In one embodiment, the flexible strap includes a first side 918 having a rough texture and a second side 920 having a smooth texture. The first side is the inner surface of the loop, and the second side is the outer surface of the loop. Therefore, the rough texture of the flexible strap is in contact with the mouthpiece and the reed. The rough texture of the flexible strap on the interior of the loop helps the ligature grip and hold the mouthpiece and reed. In addition, the rough texture improves the tonal qualities of the mouthpiece.

In one embodiment, extending partially across the flexible strap from either end of the flexible strap is a plurality of generally parallel slits 919. Each slit runs from one of the ends a given distance into the flexible strap in a direction that is generally parallel to the two parallel sides 912 of the flexible strap. In one embodiment, each slit extends across the flexible strap a distance of from about ¾ of an inch to about 1 inch. As illustrated, the flexible strap includes five slits adjacent either end; however, a larger or smaller number of slits can be provided as desired. In one embodiment, the slits are spaced from one another by a distance of about ⅛ of an inch to about ¼ of an inch. In order to preserve the integrity of the flexible strap, preferably each slit does not extend all the way to a respective end of the flexible strap. For example, the slit can begin about 1/16 to ⅛ of an inch from the end of the flexible strap. The slits contribute additional compliance or form-fitting flexibility to the strap to enhance the function of the ligature. The number of slits provided on each end can be varied depending on the amount of compliance desired or required.

Figure 16:
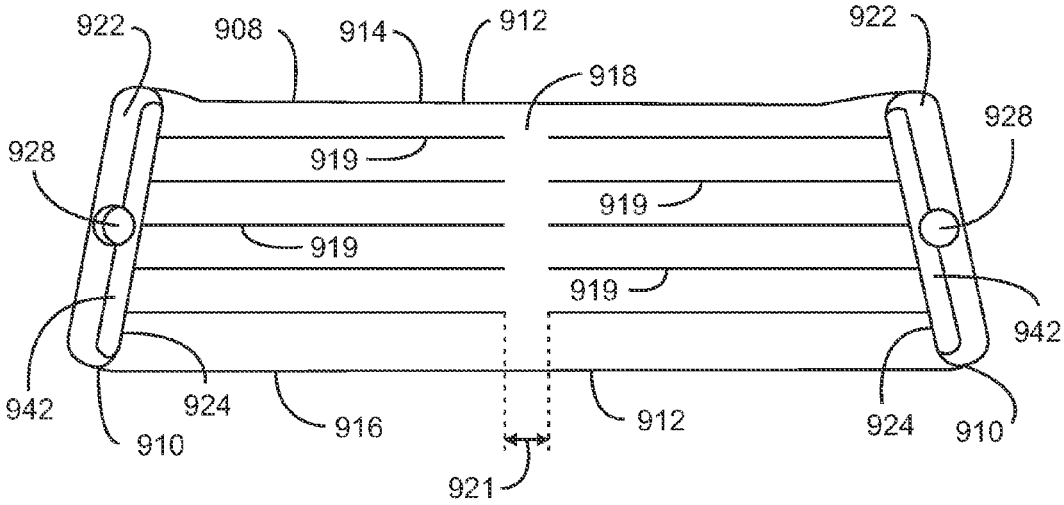
FIG. 16 is a plan view of a first side of another embodiment of a ligature having extended slits in accordance with the present invention.
Figure 17:
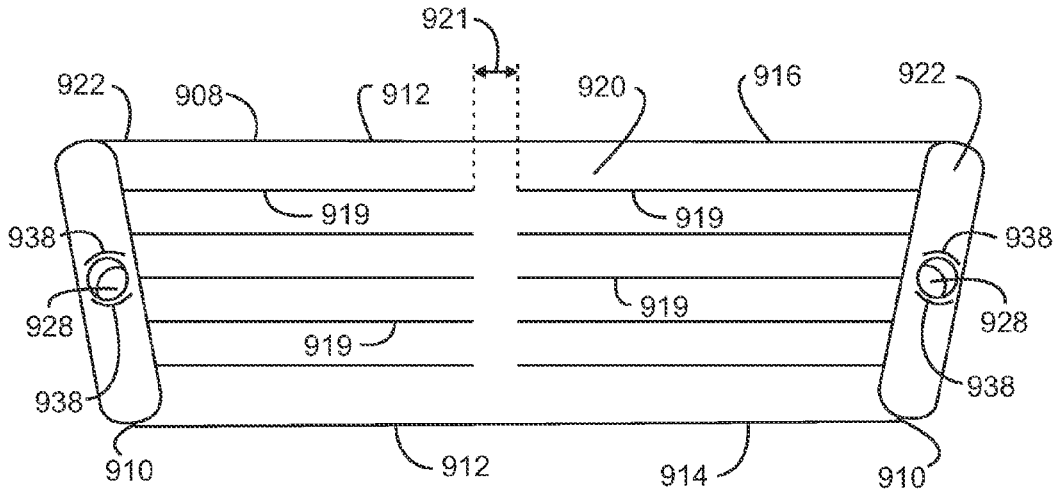
FIG. 17 is a plan view of a second side of the ligature of FIG. 16.

In one embodiment as illustrated in FIGS. 16-17, the parallel slits 919 are extended farther along the flexible strap from either end. In order to achieve improved compliance between the flexible strap of the ligature and the mouthpiece and reed, the parallel slits 911 in this embodiment are extended as far along the length of the flexible strap as possible without excessively compromising the integrity and function of the strap. For example, the parallel slits extend from each end such that the space 921 between the parallel slits represents only about 6% to about 7% of the entire length of the parallel slits, i.e., the length of the flexible strap, from end to end 910 of the flexible strap between the rigid bars 922. In one embodiment, this space represents a distance of about ¼ inch (5-10 mm).

Figure 18:
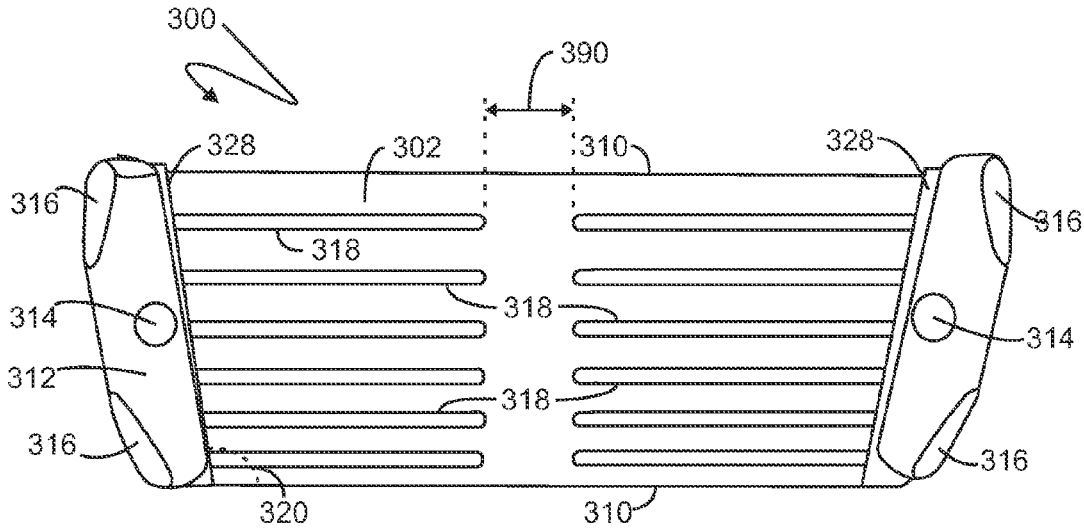
FIG. 18 is a plan view of a first side of another embodiment of a ligature having extended slots in accordance with the present invention.
Figure 19:
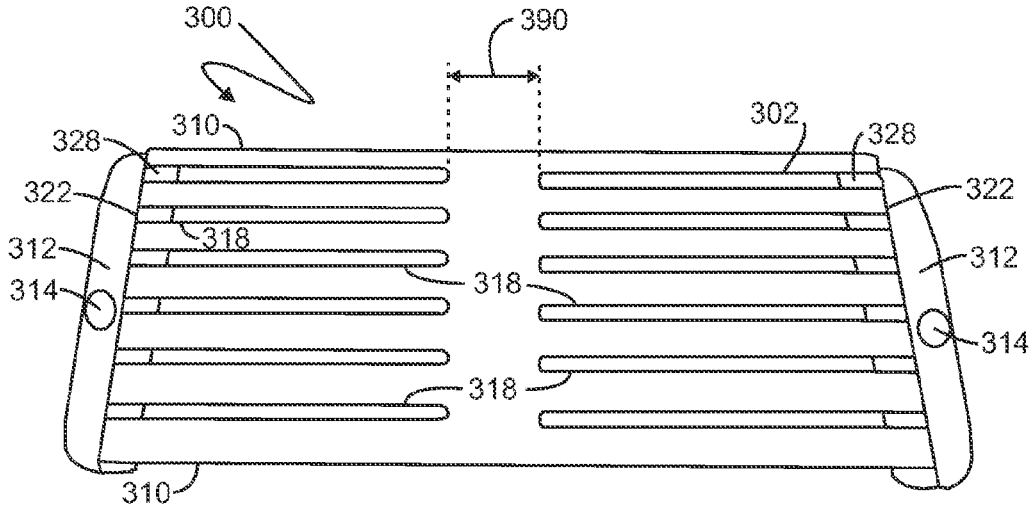
FIG. 19 is a plan view of a second side of the ligature of FIG. 18.
Figure 20:
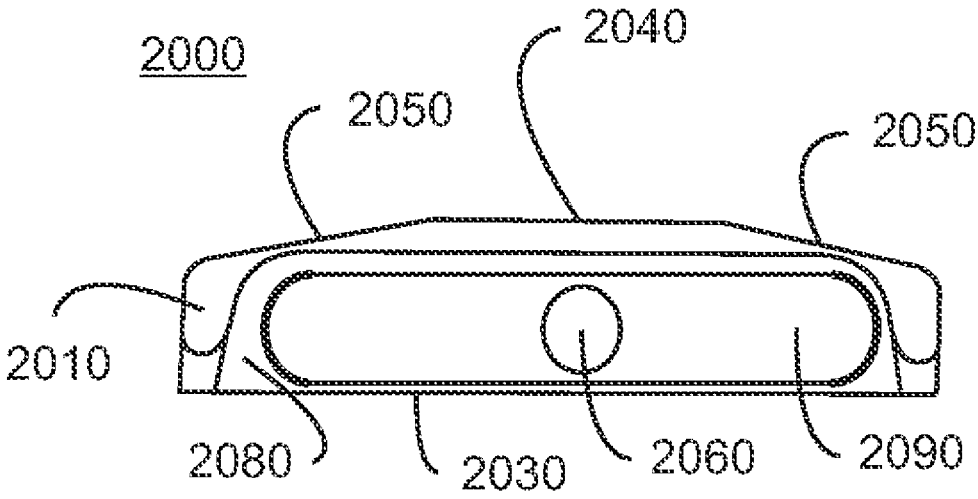
FIG. 20 is a plan view of a first side of an embodiment of a removable weight for use with the ligatures of the present invention.
Figure 21:
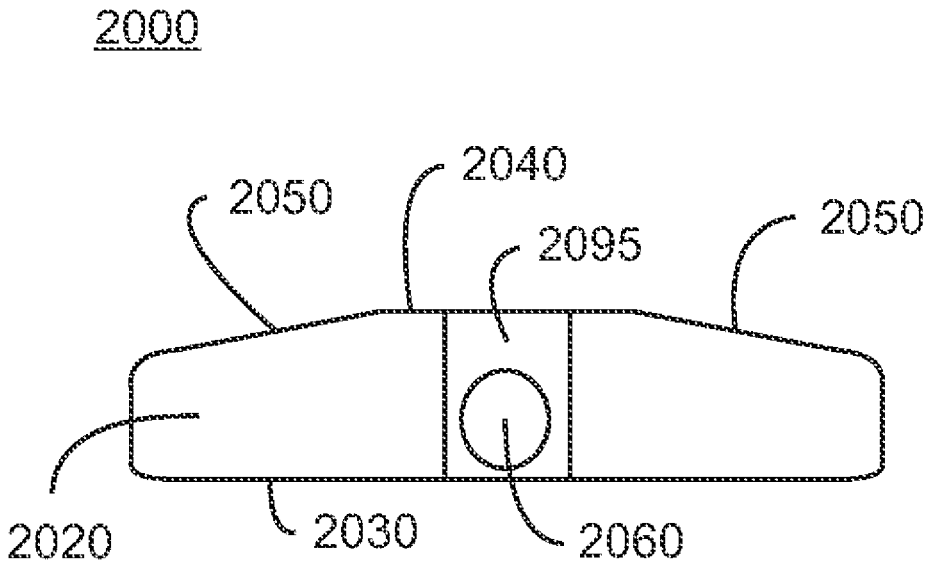
FIG. 21 is a plan view of a second side of the removable weight of FIG. 20.
Figure 22:
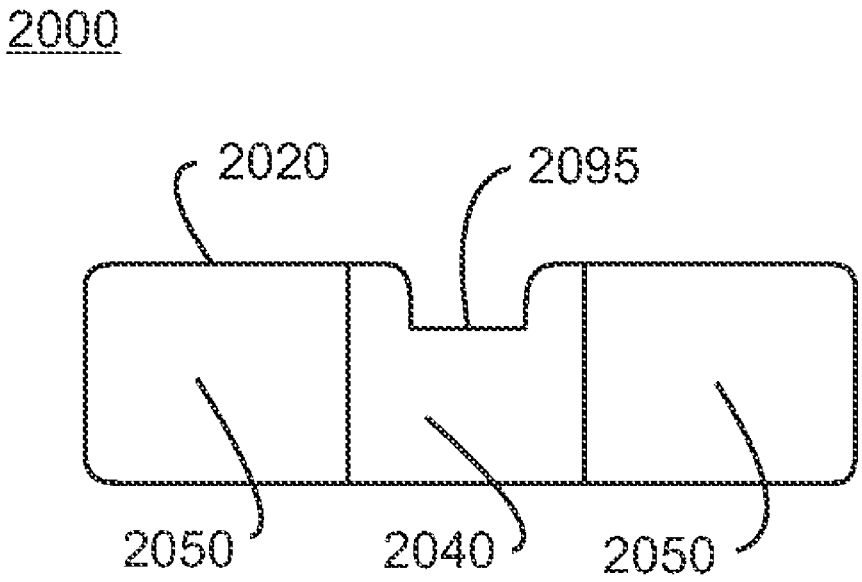
FIG. 22 is a plan view of a top side of the removable weight of FIG. 20.
Figure 23:
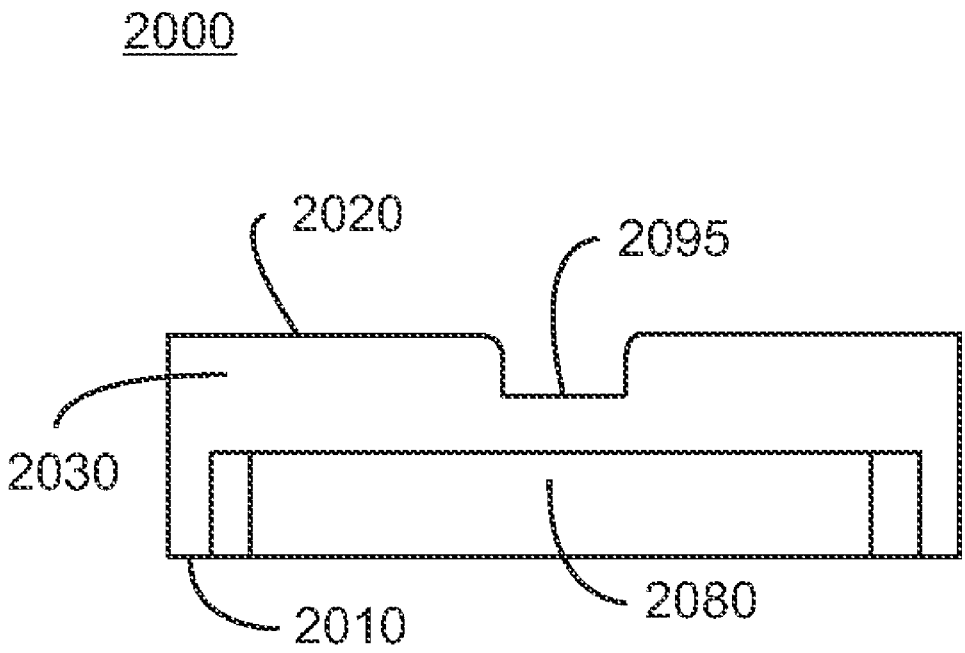
FIG. 23 plan view of a bottom side of the removable weight of FIG. 20.

Referring to FIGS. 18-19, the concept of extended slits is also applied to thin metal flexible straps 302, as provided, for example, in the embodiment of FIGS. 3-4. In this embodiment, the slits are parallel slots 318 that are extended farther along the length of the thin metal flexible straps. For example, the parallel slots extend from each end such that the space 390 between the parallel slits represents only about 16% to about 17.5% of the entire length of the parallel slots from end to end of the thin metal flexible strap between the masses 312. In one embodiment, this space represents a distance of about ½ to about 9/16 of an inch (10-15 mm). Although the extended parallel slits 919 and extended parallel slots 318 are illustrated with specific embodiments of rigid bars and masses, flexible straps with extended slits and slots can be used with any arrangement of bars and slits.

Returning to FIGS. 9-12, the ligature also includes a pair of rigid bars 922, preferably disposed on each end of the flexible strap. Suitable materials for the rigid bars include metals, plastics, elastomers, ceramics and combinations thereof. Suitable metals include brass, for example nickel or gold plated brass, and stainless steel. Each bar 922 is attached to one of the opposing ends of the flexible strap and extends between the opposing parallel sides 912. In one embodiment, each rigid bar is aligned along each end to intersect each one of the two opposing parallel sides at an angle other than 90° to create a frusto-conical shaped loop that accommodates for a tapered mouthpiece. In one embodiment, each rigid bar is a cylindrical rod having a diameter of about ¼ of an inch. In one embodiment, in order to attach each rigid bar 922 to an end 910 of the flexible strap, each cylindrical rod includes a slot 924 extending partially into the cylindrical rod and running along a length of the cylindrical rod. A corresponding end 910 of the single layer flexible strap is disposed and anchored in each slot. In one embodiment, each slot 924 extends diametrically into the cylindrical rod along a first diameter 926.

In one embodiment, each cylindrical rod 922 includes at least one hole 928 that passes completely through the cylindrical rod. The holes 928 accommodate the closure mechanism of the ligature that draws the rigid bars and, therefore, the ends of the flexible strap together to tighten the ligature around the mouthpiece 904 and the reed 906. In one embodiment, the closure mechanism is considered part of the ligature. Although various closure mechanisms, e.g., clamps and threaded fasteners, can be used, preferably, the closure mechanism is a threaded rod 930 that is passed through the holes 928 in each rigid bar. The threaded rod 930 includes a head 932 that is larger than the diameter of the hole and threads along the distal end 934 to which a threaded thumbscrew or thumbnut 936 is attached. By turning the thumbnut in the proper direction, the rigid bars are drawn together, applying a force that is decomposed into the constrictive force and perpendicular force and that tightens the ligature. In one embodiment, each cylindrical rod 922 includes notches 938 located adjacent each hole 928. These notches accommodate the heads 932 of the threaded rod 930 and prevent the threaded rod from spinning when the thumbnuts are tightened.

As was described above for other ligature embodiments, the alignment of the holes 928 with respect to the slots 924 in conjunction with the closure mechanism function to define and to hold the angle of the ends of the flexible strap with respect to the mouthpiece. In this embodiment, each hole passes diametrically through the cylindrical rod along a second diameter 940. In one embodiment, the first diameter is perpendicular to the second diameter. Preferably, the first diameter intersects the second diameter at an angle that deviates from perpendicular by up to about 7 degrees, alternatively up to about 3 degrees.

In one embodiment, each cylindrical rod includes a flat region 942 running the length of the cylindrical rod 922 and extending from one side of the slot 924 in that cylindrical rod partially around the circumference of the cylindrical rod. Therefore, the flat regions 942 are disposed in the interior of the loop formed by the flexible strap. The flat regions provide for the crimping of the ends of the flexible strap in the slot. In addition, the flat regions, being in the interior of the loop, provide clearance between the cylindrical rods and the mouthpiece as the ligature is placed around the mouthpiece and tightened.

Figure 13:
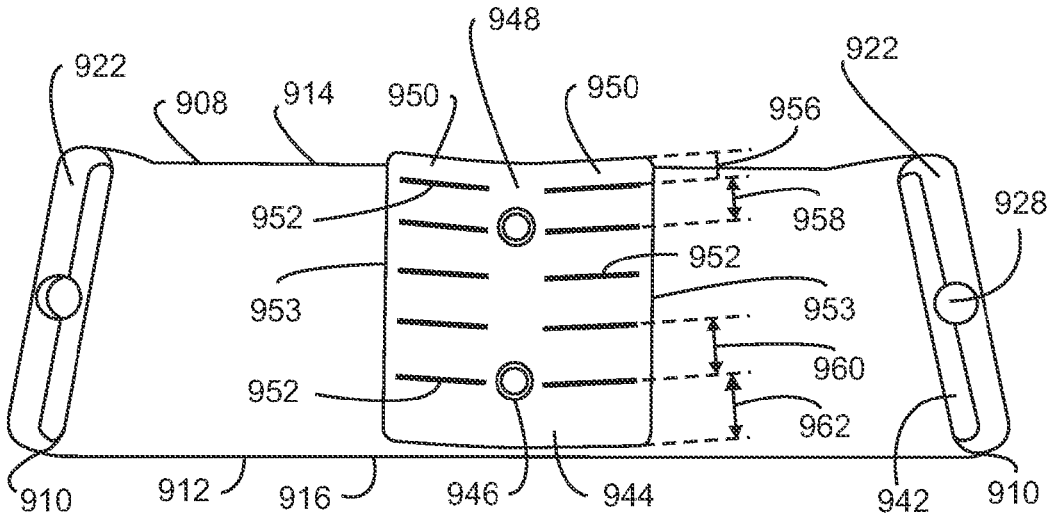
FIG. 13 is a plan view of a first side of another embodiment of a ligature in accordance with the present invention.
Figure 14:
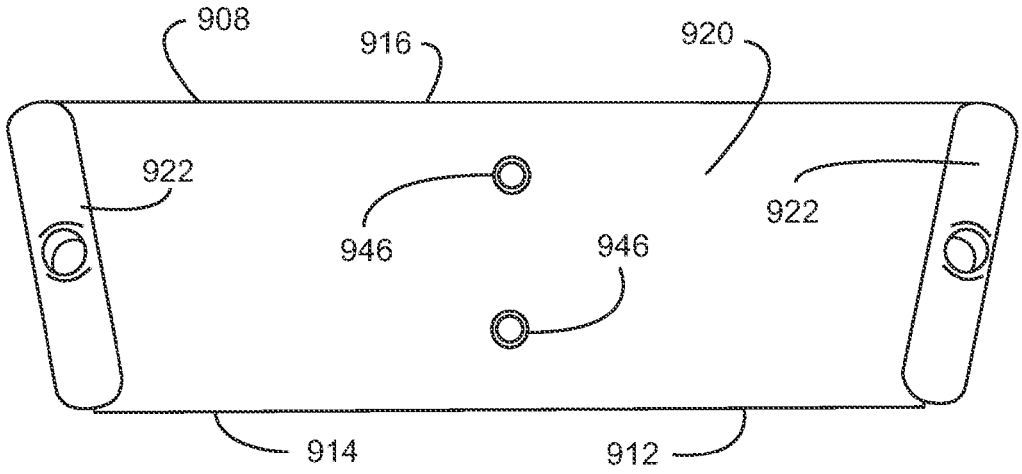
FIG. 14 is a plan view of a second side of the ligature of FIG. 13.
Figure 15:
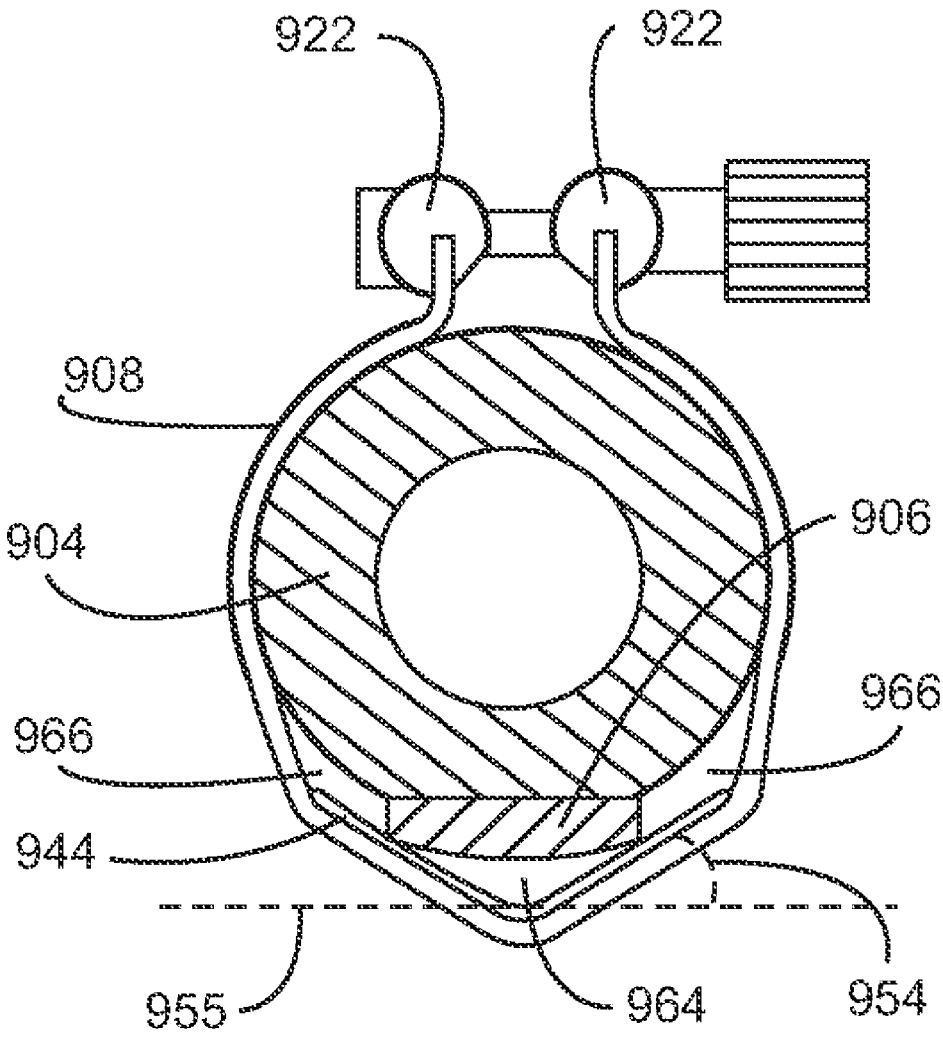
FIG. 15 is a cross-section view of an embodiment of a mouthpiece system utilizing the ligature of FIG. 13.

In accordance with another exemplary embodiment as illustrated in FIGS. 13-15, the present invention is directed to a ligature that includes a u-shaped cradle 944 attached to the flexible strap 908. Although illustrated as being attached to a particular ligature, the cradle 944 can be attached to any of the ligatures described herein. The cradle can be attached to the flexible strap using any type and any number of fasteners. Preferably, the cradle is attached to the flexible strap using two rivet connections 946. The cradle is constructed from a flexible or semi-flexible, resilient material. Preferably, the cradle is constructed from spring steel, i.e., stainless steel. The cradle is attached to the flexible strap between the two opposing ends 910 and is disposed on the interior 918 of the loop. Therefore, cradle is interposed between the flexible strap body of the ligature and reed 906, contacting the reed only on the edges of the reed. This arrangement between the reed and the cradle significantly enhances the performance of the reed. The cradle is structured to behave as a spring-like element to permit free vibration of the reed but with sufficient stiffness to retain control by the player.

The cradle includes a central portion 948 in contact with the flexible strap 908 and a pair of wings 950 or sides extending from the central portion 948 to form the u-shape. As illustrated in FIG. 15, the wings extend from the central portion so as to form an angle 954 of from about 30 degrees to about 50 degrees with the flexible strap, for example, when the flexible strap is positioned flat in a single plane 955. Preferably, this angle 954 is about 40 degrees. Although the cradle 944 is u-shaped, is it constructed from a generally rectangular piece of resilient material, having, for example, dimensions of about 1 inch by about 1 inch.

Each wing includes a plurality of parallel slits 952. As illustrated, each wing includes 6 slits, although smaller or larger numbers of slits can be used. The slits are arranged on each wing such that the wings appear as mirror images. The parallel slits are arranged parallel to the opposing sides 912 of the flexible strap 908. Each slit is about ⅜ of an inch long. The slits do not extend to the edges 953 of the wings and do not extend into the central portion 948 of the cradle 944. This adds to the strength and resiliency of the cradle. The spacing between adjacent parallel slits varies. In particular, the distance between adjacent parallel slits increases when moving along each wing 950 from the first parallel side 914 to the second parallel side 916. In one embodiment, this variable distance increases from a first distance 958 of about 1/10 of an inch to a second distance 960 of about 2/10 of an inch. In addition, the cradle includes a leading edge spacing 956 from the first slit of about 1/10 of an inch and a trailing edge spacing 962 after the last slit of about 2/10 of an inch.

As is best illustrated in FIG. 15, the cradle 944 contacts the reed 906 along two lines, i.e., two points in cross section, that run along the edges of the reed. In addition, the cradle spaces the ligature, and in particular the flexible strap 908 away from the reed and mouthpiece, creating a top gap 964 between the reed and the ligature and two side gaps 966. These gaps improve the tonal qualities of the mouthpiece.

Referring to FIGS. 20-23, an exemplary embodiment of a removable mass 2000 that is secured to a ligature or mouthpiece in accordance with the present invention is illustrated. A single mass is illustrated; however, a given ligature can have one, two or more masses removably or releasably attached. Preferably, the ligature includes two removable masses, one each attached to a given end of the ligature. Additional removable masses are added in pairs to the ends of the ligature. The masses can represent different amounts of mass or weight and can be added in groupings until the desired amount of mass has been added to the ligature. In one embodiment, the removable masses are provided in various matched pairs such that a given pair provides the desired amount of mass. Preferably, a given pair adds a sufficient amount of weight to the ligature to lower the passband frequencies of internal resonances of the ligature sufficiently below passband frequencies of the vibrating reed that is secured to the mouthpiece by the ligature.

The removable masses can be attached to the ends of the ligature through any suitable attachment mechanism. For example, the removable masses can be attached to the rods or masses that are securely fastened to the ends of the flexible strap by magnetic fasteners, two-part fasteners such as hook and loop type fasteners and threaded fasteners. Preferably the removable masses are attached to the ligature using the existing closure mechanism of the ligature. Suitable materials for the masses include brass, stainless steel and lead.

In one embodiment, a single pair of identical removable masses is provided for attachment to the ligatures of the present invention. One of the masses in a pair of identical removable masses is illustrated in the figures. The removable mass 2000 is arranged and shaped to work with the existing rods or weights on the end of the ligature in a form-fitting arrangement without adding excessive size to the ligature that would interfere with the playing of the mouthpiece.

As illustrated, the removable mass has a generally elongated rectangular shape and includes a first side 2010 having a cavity 2080 for accommodating the ends of the ligature. The size and shape of the cavity 2080 corresponds to the size and shape of the ends of the ligature to which it is attached. Typically, the ends of the ligature have a mass or rod attached to the flexible strap. Therefore, in one embodiment, the cavity 2080 includes an elongated curved pocket 2090 with curved ends that accommodates the cylindrical rods with rounded ends that are attached to the ends of the flexible strap of the ligature.

A second side 2020 is provided opposite the first side. This second side is generally flat, but has a channel 2095 running through the middle and spanning the entire width of the second side from a top side 2040 to a bottom side 2030. A hole 2060 passes from the channel 2095 to the cavity 2080. The hole 2060 accommodates the threaded rod of the closure mechanism, and the channel 2095 accommodates the head of the threaded rod. The top side 2040 includes tapers 2050 similar to the tapers on the fixed masses. As shown from the bottom side 2030, the cavity 2080 extends along the bottom side so that the rods at the end of the flexible strap are not completely covered or surrounded by the bottom side.

Figure 24:
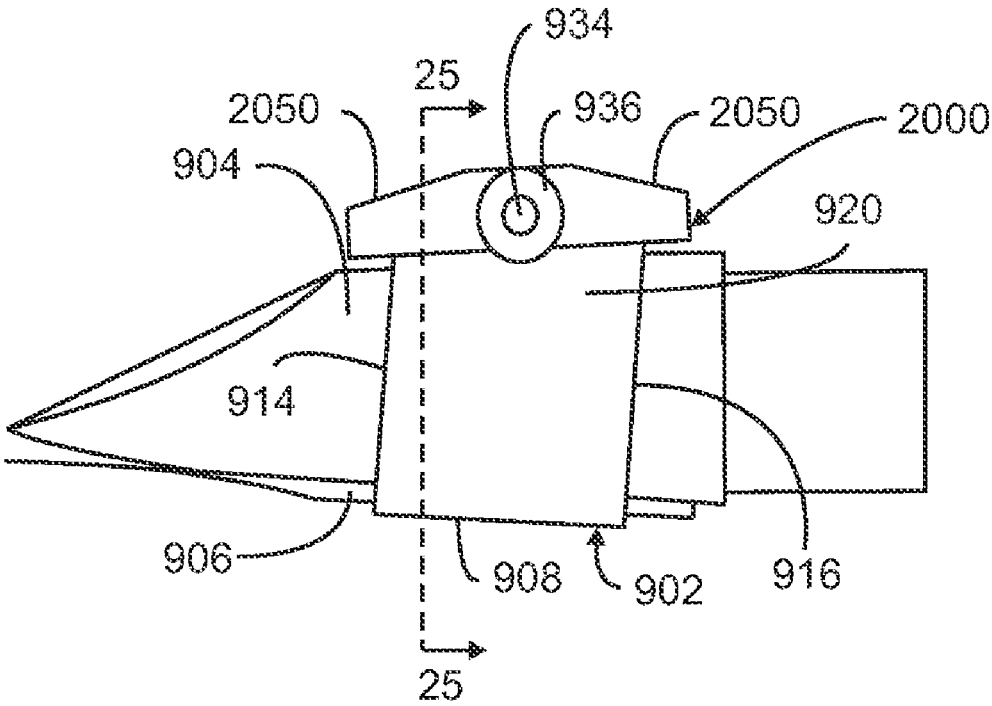
FIG. 24 is a side view of a mouthpiece system utilizing an embodiment of a ligature with removable masses in accordance with the present invention.
Figure 25:
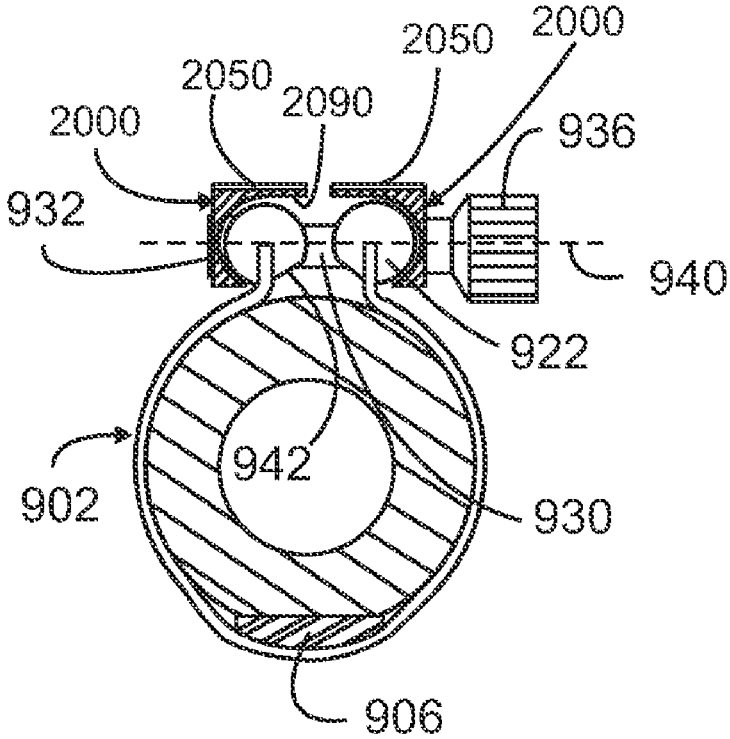
FIG. 25 is a view through line 25-25 of FIG. 24.

As illustrated in FIGS. 24 and 25, each removable mass is attached to an end of the flexible strap. Although illustrated with a particular embodiment of the ligature, the removable masses can be attached to any suitable type of ligature including all of the embodiments of ligatures disclosed herein. In addition, the removable masses can be positioned on the mouthpiece adjacent the reed 906 or on the opposite side of the mouthpiece from the reed 906. Each removable mass is placed around the cylindrical rods 922 at the end of the flexible strap such that the cylindrical rods rest in the curved pockets 2090 of the cavity. The threaded rod is passed through the hole in the second side of one of the removable masses until the head 932 is located within the channel 2095. The thumbscrew 936 is then threaded onto the rod, drawing the ends of the flexible strap of the ligature together and securing the removable masses to the ends of the ligature. In one embodiment, the removable masses are sized and arranged such that the bottom sides do not contact each other when the thumbscrew is tightened and the removable masses are secured to the flexible strap.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s) and steps or elements from methods in accordance with the present invention can be executed or performed in any suitable order. Therefore, it will be understood that the appended claims are intended to cover all such modifications and embodiments, which would come within the spirit and scope of the present invention.

What is claimed is:

1. A ligature for a mouthpiece, the ligature comprising:

a loop sized to encircle a mouthpiece and comprising:

a single layer of resilient flexible strap having two opposing ends and two opposing parallel sides, the two opposing parallel sides comprising a first side having a first length and a second side having a second length, the second length greater than the first length;

a plurality of slits extending partially across the flexible strap from either end of the flexible strap parallel to the sides of the flexible strap; and a space between parallel slits extending from opposite ends of the flexible strap, the space comprising about 6% to about 7% of an entire length of at least one of the first length and the second length; and a pair of rigid bars, each bar attached to one of the opposing ends of the flexible strap and extending between the opposing parallel sides.

2. The ligature of claim 1, wherein each rigid bar comprises a cylindrical rod having a diameter of about ¼ of an inch and the flexible strap has a thickness of about 1/32 of an inch.

3. The ligature of claim 1, wherein each rigid bar comprises a cylindrical rod and each cylindrical rod comprises a slot extending partially into the cylindrical rod and running along a length of the cylindrical rod, a corresponding end of the single layer flexible strap disposed and anchored in the slot.

4. The ligature of claim 3, wherein each cylindrical rod further comprises a hole passing completely through the cylindrical rod.

5. The ligature of claim 4, wherein each slot extends diametrically into the cylindrical rod along a first diameter and each hole passes diametrically through the cylindrical rod along a second diameter, the first diameter perpendicular to the second diameter.

6. The ligature of claim 4, wherein each slot extends diametrically into the cylindrical rod along a first diameter and each hole passes diametrically through the cylindrical rod along a second diameter, the first diameter intersecting the second diameter at an angle that deviates from perpendicular by up to about 7 degrees.

7. The ligature of claim 1, wherein each cylindrical rod is aligned along each end to intersect each one of the two opposing parallel sides at an angle other than 90° to create a frustoconical shaped loop that accommodates a tapered mouthpiece.

8. The ligature of claim 1, wherein the flexible strap comprises a rubberized fabric.

9. The ligature of claim 1, wherein the flexible strap comprises a first side having a rough texture and a second side having a smooth texture, the first side comprising an inner surface of the loop and the second side comprising an outer surface of the loop.

10. The ligature of claim 3, wherein each cylindrical rod further comprises a flat region running the length of the cylindrical rod and extending from one side of the slot partially around the circumference of the cylindrical rod.

11. The ligature of claim 10, wherein the flat regions are disposed in the interior of the loop.

12. The ligature of claim 1, wherein the space comprises a length of about ¼ inches.

13. A ligature for a mouthpiece, the ligature comprising:

a loop sized to encircle a mouthpiece and comprising:

a single layer of resilient flexible strap having two opposing ends and two opposing parallel sides, the two opposing parallel sides comprising a first side having a first length and a second side having a second length, the second length greater than the first length;

a plurality of slots extending partially across the flexible strap from either end of the flexible strap parallel to the sides of the flexible strap; and a space between parallel slots extending from opposite ends of the flexible strap, the space comprising about 16% to about 17.5% of an entire length of at least one of the first length and the second length; and a pair of rigid bars, each bar attached to one of the opposing ends of the flexible strap and extending between the opposing parallel sides.

14. The ligature of claim 13, wherein the space comprises a length of ½ inches or 9/16 inches.

15. A ligature for a mouthpiece, the ligature comprising:

a loop comprising a thin resilient flexible strap having two ends, the loop sized to encircle a mouthpiece;

a pair of rigid bars, each bar attached to one of the ends of the flexible strap; and a pair of removable masses attached to the removable strap, each removable mass in contact with one of the rigid bars and the pair of removable masses in combination comprising sufficient weight to lower passband frequencies of internal resonances of the ligature sufficiently below passband frequencies of a vibrating reed secured to the mouthpiece by the ligature.

16. The ligature of claim 15, wherein the pair of removable masses comprise identical masses.

17. The ligature of claim 15, wherein each removable mass comprises a cavity having a shape that accommodates one of the rigid bars, the rigid bar disposed in the cavity when the removable mass is attached to the flexible strap.

18. The ligature of claim 17, wherein each rigid bar comprises a cylindrical rod with rounded ends and the cavity in each removable mass comprises a curved pocket with curved ends.

19. The ligature of claim 17, wherein each rigid bar and each removable mass comprises a single through hole, the through holes of the rigid bars and removable masses aligned when the removable masses are attached to the flexible strap.

20. The ligature of claim 19, further comprising a threaded rod passing completely through all of the through holes and a thumbscrew attached to a distal end of the threaded rod, the threaded rod and thumbscrew securing the removable masses to the flexible strap.

* * * * *